US009701000B2

(12) United States Patent
Sekino et al.

(10) Patent No.: US 9,701,000 B2
(45) Date of Patent: Jul. 11, 2017

(54) IMPACT ROTATION TOOL AND IMPACT ROTATION TOOL ATTACHMENT

(71) Applicant: PANASONIC CORPORATION, Osaka (JP)

(72) Inventors: Fumiaki Sekino, Osaka (JP); Kenichirou Inagaki, Shiga (JP); Toshiharu Ohashi, Shiga (JP); Tadashi Arimura, Kyoto (JP); Ryuji Otani, Osaka (JP); Mitsumasa Mizuno, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 412 days.

(21) Appl. No.: 14/333,046

(22) Filed: Jul. 16, 2014

(65) Prior Publication Data

US 2015/0021062 A1 Jan. 22, 2015

(30) Foreign Application Priority Data

Jul. 19, 2013 (JP) ..... 2013-150650
Sep. 27, 2013 (JP) ..... 2013-202348

(51) Int. Cl.
*B25B 21/02* (2006.01)
*B25B 23/147* (2006.01)
(Continued)

(52) U.S. Cl.
CPC ..... *B25B 23/1475* (2013.01); *B25B 21/007* (2013.01); *B25B 21/02* (2013.01);
(Continued)

(58) Field of Classification Search
CPC ..... B25B 21/02; B25B 23/14; B25B 23/145; B25B 23/1405; B25B 23/147; B25B 23/1453; B23P 19/06; B23P 19/066
(Continued)

(56) References Cited

U.S. PATENT DOCUMENTS 4,620,450 A 11/1986 Yamaguchi
5,212,862 A * 5/1993 Eshghy ..... B25B 23/14 29/240

(Continued)

FOREIGN PATENT DOCUMENTS

CN 1607075 A 4/2005
CN 103052472 A 4/2013

(Continued)

OTHER PUBLICATIONS

Extended European Search Report issued in corresponding European Patent Application No. 14177212.9, mailed on Jun. 24, 2015; 6 pages.

(Continued)

*Primary Examiner* — Scott A. Smith
(74) *Attorney, Agent, or Firm* — McDermott Will & Emery LLP

(57) ABSTRACT

An impact rotation tool including a drive source, an impact force generation unit that generates an impact force for converting power from the drive source to pulsed torque, a shaft that transmits the pulsed torque to a bit used to perform a tightening task, a torque measurement unit that measures torque applied to the shaft as measured torque, a rotation angle measurement unit that measures a rotation angle of the shaft, a tightening torque calculation unit that calculates an angular acceleration from the rotation angle to calculate a tightening torque based on the angular acceleration and the
(Continued)

measured torque, and a controller that controls the drive source based on the tightening torque.

15 Claims, 14 Drawing Sheets

(51) Int. Cl.
*B25B 23/14* (2006.01)
*B25B 21/00* (2006.01)
*B25B 23/145* (2006.01)

(52) U.S. Cl.
CPC ..... *B25B 21/026* (2013.01); *B25B 23/14* (2013.01); *B25B 23/1405* (2013.01); *B25B 23/1453* (2013.01); *B25B 23/147* (2013.01)

(58) Field of Classification Search
USPC .... 173/2, 176, 179, 181, 182, 83, 93, 93.51; 318/432, 689, 568.12; 73/862.23, 761
See application file for complete search history.

(56) References Cited

U.S. PATENT DOCUMENTS

| | | | | |
|---|---|---|---|---|
| 5,315,501 | A * | 5/1994 | Whitehouse | B23P 19/066 173/176 |
| 5,366,026 | A * | 11/1994 | Maruyama | B23P 19/066 173/180 |
| 5,502,883 | A | 4/1996 | Ohmi et al. | |
| 6,134,973 | A * | 10/2000 | Schoeps | B25B 23/1453 173/183 |
| 6,263,742 | B1 * | 7/2001 | Gruson | B67B 3/2073 173/181 |
| 6,371,218 | B1 | 4/2002 | Amano et al. | |
| 6,581,696 | B2 * | 6/2003 | Giardino | B25B 23/1405 173/1 |
| 7,770,658 | B2 * | 8/2010 | Ito | B23P 19/066 173/1 |
| 7,958,944 | B2 * | 6/2011 | Lehnert | B25B 23/1405 173/1 |
| 8,482,242 | B2 * | 7/2013 | Nakasugi | B25J 9/1633 318/432 |
| 2005/0109519 | A1 | 5/2005 | Kawai et al. | |
| 2005/0263304 | A1 | 12/2005 | Sainomoto et al. | |
| 2010/0138127 | A1 | 6/2010 | Boughtwood | |
| 2013/0049498 | A1 | 2/2013 | Boughtwood | |
| 2013/0133912 | A1 | 5/2013 | Mizuno et al. | |
| 2013/0134839 | A1 | 5/2013 | Boughtwood | |

FOREIGN PATENT DOCUMENTS

| | | | |
|---|---|---|---|
| DE | 198 45 871 | A | 4/1999 |
| EP | 0 171 058 | A2 | 2/1986 |
| EP | 0 627 282 | A1 | 12/1994 |
| GB | 2273574 | A | 6/1994 |
| JP | S57-114370 | A | 7/1982 |
| JP | 07-308865 | A | 11/1995 |
| JP | 09-155755 | A | 6/1997 |
| JP | 11-129163 | A | 5/1999 |
| JP | 2000-354976 | A | 12/2000 |
| JP | 2001-341079 | A | 12/2001 |
| JP | 2002-321165 | A | 11/2002 |
| JP | 2005-125425 | A | 5/2005 |
| JP | 2005-279865 | A | 10/2005 |
| JP | 2005-324265 | A | 11/2005 |
| JP | 2012-035358 | A | 2/2012 |
| JP | 2012-206181 | A | 10/2012 |
| JP | 2013-039032 | A | 2/2013 |

OTHER PUBLICATIONS

Chinese Office Action issued in corresponding Chinese Patent Application No. 201410338861.0, mailed on Aug. 3, 2015; 7 pages.
Notification of Reasons for Refusal, issued in corresponding Japanese Patent Application No. 2013-150650, mailed on Dec. 20, 2016; with English translation.
European Office Action issued in Application No. 14177212.9 dated Jan. 5, 2017.

* cited by examiner

IMPACT ROTATION TOOL AND IMPACT ROTATION TOOL ATTACHMENT

CROSS-REFERENCE TO RELATED APPLICATIONS

This application is based upon and claims the benefit of priority from prior Japanese Patent Application Nos. 2013-150650, filed on Jul. 19, 2013, and 2013-202348, filed on Sep. 27, 2013, the entire contents of which are incorporated herein by reference.

FIELD

This disclosure relates to an impact rotation tool and an impact rotation tool attachment.

BACKGROUND

An impact rotation tool reduces the speed of the rotation force of a motor with a speed reduction mechanism and converts the decelerated rotation force to a pulsed impact torque using hydraulic pressure or hammer impacts to perform a fastening task or a loosening task (refer to Japanese Laid-Open Patent Publication No. 2012-206181). In comparison with a rotation tool that uses only a speed reduction mechanism, an impact rotation tool obtains higher torque and thus improves the workability. Impact rotation tools are widely used at construction sites and assembly plants.

The impact rotation tool generates high torque and may overtighten fasteners such as bolts or screws. However, when loosely tightening a fastener to avoid overtightening, the fastener may not be fastened with the desired strength.

To tighten a fastener with a predetermined torque, a torque sensor may be arranged on the rotation shaft of the motor to measure the torque applied to the rotation shaft. Further, Japanese Laid-Open Patent Publication No. 2005-125425 describes an impact tightening tool that computes the torque by detecting the rotation angle of a motor with a rotary encoder, differentiating the rotation angle twice to compute the angular acceleration, and multiplying the angular acceleration with the moment of inertia. When the computed torque value reaches a target torque value that is set in advance, the motor is stopped.

SUMMARY

In the conventional impact rotation tool, the torque acting on the rotation shaft of the motor is measured, and the measured torque is obtained as the tightening torque. However, the output torque of the motor includes torque for rotating a main shaft. Thus, it is difficult to calculate the actual tightening torque from the measured torque. As a result, depending on the tightened subject, the motor may be stopped even though the actual torque completely differs from the target torque.

It is an object of the present invention to provide an impact rotation tool and an impact rotation tool attachment capable of calculating the tightening torque with high accuracy.

A first aspect of the present invention is an impact rotation tool including a drive source, an impact force generation unit configured to generate an impact force for converting power from the drive source to pulsed torque, a shaft arranged to transmit the pulsed torque to a bit used to perform a tightening task, a torque measurement unit configured to measure torque applied to the shaft as measured torque, a rotation angle measurement unit configured to measure a rotation angle of the shaft, a tightening torque calculation unit configured to calculate an angular acceleration from the rotation angle and calculate a tightening torque based on the angular acceleration and the measured torque, and a controller configured to control the drive source based on the tightening torque.

A second aspect of the present invention is an impact rotation tool attachment that is attachable to an impact rotation tool. The impact rotation tool includes an impact force generation unit configured to generate impact force for converting power from a drive source to pulsed torque, a shaft arranged to transmit the pulsed torque to a bit used to perform a tightening task, and a controller configured to control the drive source. The attachment includes a torque measurement unit configured to measure torque applied to the shaft as a measured torque, a rotation angle measurement unit configured to measure a rotation angle of the shaft, and a tightening torque calculation unit configured to calculate an angular acceleration from the rotation angle to calculate a tightening torque based on the angular acceleration and the measured torque.

A third aspect of the present invention is an impact rotation tool including a drive source, an impact force generation unit configured to generate an impact force for converting power from the drive source to pulsed torque, a shaft arranged to transmit the pulsed torque to a bit used to perform a tightening task, a first measurement unit configured to measure torque applied to the shaft as a measured torque, a second measurement unit configured to measure at least one of an acceleration in a circumferential direction of the shaft and an angular velocity of the shaft, a torque computation unit configured to calculate a tightening torque from the measured torque of the first measurement unit and an inertial torque of the shaft and the bit obtained with a measured value of the second measurement unit, and a controller configured to control the drive source based on the tightening torque.

A fourth aspect of the present invention is an impact rotation tool attachment that is attachable to an impact rotation tool. The impact rotation tool includes an impact force generation unit configured to generate impact force for converting power from a drive source to pulsed torque, a shaft arranged to transmit the pulsed torque to a bit used to perform a tightening task, and a controller configured to control the drive source. The attachment includes a first measurement unit configured to measure torque applied to the shaft as a measured torque, a second measurement unit configured to measure at least one of an acceleration in a circumferential direction of the shaft and an angular velocity of the shaft, and a torque computation unit configured to obtain a tightening torque from the measured torque of the first measurement unit and an inertial torque of the shaft and the bit obtained with a measured value of the second measurement unit. The torque computation unit is configured to output to the controller at least one of the calculated value of the tightening torque and a control signal of the drive source generated based on the calculated value of the tightening torque.

The impact rotation tool and the impact rotation tool attachment described above are capable of calculating the tightening torque with high accuracy.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION

A first embodiment of an impact rotation tool will now be described with reference to the drawings.

Figure 1:
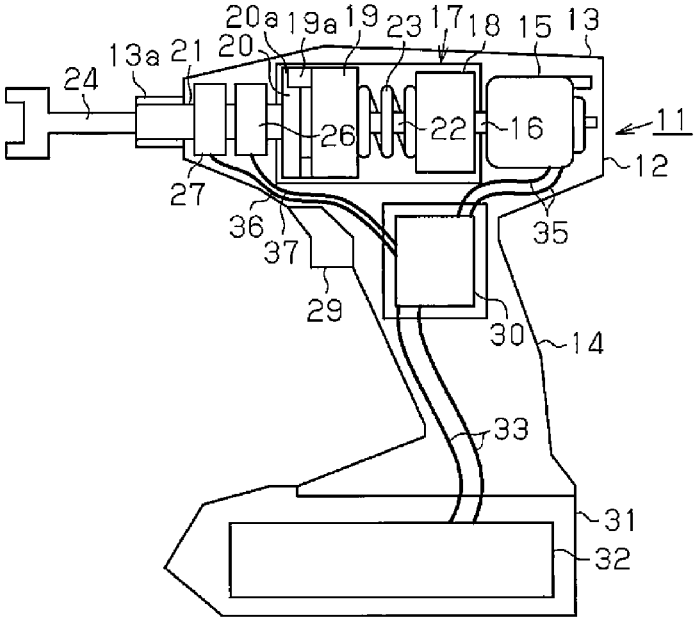
FIG. 1 is a schematic cross-sectional side view showing a first embodiment of an impact rotation tool.

Referring to FIG. 1, an impact rotation tool 11 is of a hand-held type and can be held with a single hand. Further, the impact rotation tool 11 is, for example, an impact driver or an impact wrench. A housing 12, which forms the shell of the impact rotation tool 11, includes a barrel 13, which is tubular and has a closed end, and a grip 14, which extends from the barrel 13. The grip 14 extends from the barrel 13 in a direction (lower side in FIG. 1) intersecting the axis of the barrel 13.

A motor 15, which serves as one example of a drive source, is located in the barrel 13 at a basal side, or right side as viewed in FIG. 1. The motor 15 is arranged in the barrel 13 so that the rotation axis of the motor 15 coincides with the axis of the barrel 13, and an output shaft 16 of the motor 15 faces the distal side of the barrel 13. The motor 15 is a DC motor, such as a brush motor or a brushless motor. An impact force generator 17 is connected to the output shaft 16 of the motor 15. The impact force generator 17 converts the rotation force of the motor 15 to pulsed torque and generates impact force.

In order from the output side of the motor 15, the impact force generator 17 includes a speed reduction mechanism 18, a hammer 19, an anvil 20, and a main shaft 21, which is one example of a shaft.

The speed reduction mechanism 18 reduces the speed of the rotation produced by the motor 15 by a predetermined speed reduction ratio. The rotation force of the high torque obtained by the speed reduction mechanism 18 is transmitted to the hammer 19. The hammer 19 strikes the anvil 20. The impact of the hammer 19 applies rotation force to the main shaft 21. The main shaft 21 may be formed integrally with the anvil 20 as a portion of the anvil 20. Alternatively, the main shaft 21 may be formed discretely from the anvil 20 and be fixed to the anvil 20.

The hammer 19 is rotatable relative to a drive shaft 22 of the speed reduction mechanism 18 and slidable in the forward and rearward directions along the drive shaft 22. The urging force of a coil spring 23, which is arranged between the speed reduction mechanism 18 and the hammer 19, urges the hammer 19 toward the distal side (left side as viewed in FIG. 1) of the barrel 13 and pushes the hammer 19 against the anvil 20.

Two projections 19*a* project from the front surface of the hammer 19 toward the anvil 20. The projections 19*a* are arranged at equal intervals in the circumferential direction. Each projection 19*a* abuts, in the circumferential direction, against one of two projections 20*a* projecting from the anvil 20 in the radial direction. When a projection 19*a* of the hammer 19 abuts against a projection 20*a* of the anvil 20, the hammer 19 and the anvil 20 are integrally rotated. The integral rotation of the hammer 19 and the anvil 20 transmits the rotation force of the drive shaft 22, which has been decelerated by the speed reduction mechanism 18, to the main shaft 21, which is coaxial with the anvil 20. A chuck 13*a* is arranged on the distal end (left end as viewed in FIG. 1) of the barrel 13. The chuck 13*a* includes a socket to receive a bit 24 in a removable manner.

When the tightening of a fastener such as a bolt or a screw advances as the bit 24 rotates, the load applied to the main shaft 21 becomes greater than that when the tightening of the fastener starts. When the loosening of a fastener such as a bolt or a screw advances as the bit 24 rotates, the load applied to the main shaft 21 becomes smaller than that when the loosening of the fastener starts. When torque of a predetermined value or greater is applied between the hammer 19 and the anvil 20, the hammer 19 moves toward the rear (rightward as viewed in FIG. 1) while compressing the coil spring 23. As the hammer 19 moves toward the rear and away from the anvil 20, the projection 19*a* is separated from the projection 20*a*, and the hammer 19 is freely rotated. When the hammer 19 is rotated by a predetermined angle relative to the anvil 20, as the hammer 19 rotates, the urging force of the coil spring 23 moves the hammer 19 toward the anvil 20 and strikes the anvil 20 again. The striking with the hammer 19 is repeated whenever the hammer 19 is rotated by a predetermined amount or greater relative to the anvil by the load acting one the main shaft 21. Such striking of the anvil 20 with the hammer 19 acts as an impact on the fastening member.

As shown in FIG. 1, a shaft torque sensor 26 and a rotation encoder 27 are attached to the main shaft 21 of the impact rotation tool 11.

The shaft torque sensor 26 is, for example, a magnetostrictive sensor. The shaft torque sensor 26 detects with a coil arranged on a non-rotated portion, changes in the magnetic permeability that is in accordance with the strain generated in the main shaft 21 when torque is applied to the main shaft 21. Then, the shaft torque sensor 26 generates a voltage signal that is proportional to the strain. The voltage signal output from the shaft torque sensor 26 is a torque detection signal S1 (refer to FIG. 4A). The torque detection signal S1 is provided from the shaft torque sensor 26 to a shaft torque measurement unit 41 of a control circuit 30.

The rotation encoder 27 provides a rotation angle calculation unit 42 with pulses of two phases (A phase and B phase) in accordance with the rotation of the main shaft 21. The rotation angle calculation unit calculations a rotation angle change (rotation angle θ) of the main shaft 21 based on the pulses of two phases. In the present embodiment, the rotation encoder 27 and the rotation angle calculation unit 42 function as a rotation angle measurement unit.

A trigger lever 29 is arranged on the grip 14. A user operates the trigger lever 29 to drive the impact rotation tool 11. A battery pack holder 31, which is formed by a box-shaped case, is attached in a removable manner to the lower end of the grip 14. The battery pack holder 31 accommodates a battery pack 32, which is a rechargeable battery. The impact rotation tool 11 is of a chargeable type that uses the battery pack 32 as a drive power source. A power line 33 connects the battery pack 32 to the control circuit 30.

The motor 15 includes a speed detector 34 that detects the rotation speed of the motor 15. The speed detector 34 may be realized by a frequency generator that generates a frequency signal having a frequency proportional to the rotation speed of the motor 15. The speed detector 34 may be, for example, a rotation encoder. When the motor 15 is a brushless motor, the speed detector 34 may be a Hall sensor, and the rotation speed may be detected from the signal of the Hall sensor or from back electromotive force. The speed detector 34 provides the control circuit 30 with an output signal corresponding to the rotation speed of the motor 15.

The control circuit 30, which is electrically connected to the motor 15 by a lead line 35, controls the driving and the like of the motor 15. A trigger switch, which detects the operation of the trigger lever 29, is electrically connected to the control circuit 30.

When the user operates the trigger lever 29, the control circuit 30 executes control for changing the rotation speed or the like of the motor 15 in accordance with the pulled amount of the trigger lever 29. The control circuit 30 controls the flow of current to the motor 15 with a motor driver and performs rotation control and torque setting of the motor 15.

Further, the control circuit 30 is connected to the rotation encoder 27 by a signal line 36 and connected to the shaft torque sensor 26 by a signal line 37. The control circuit 30 calculates a tightening torque value using the output signal of the shaft torque sensor 26 and the output signal of the rotation encoder 27. When the tightening torque value exceeds a set torque value, the control circuit 30 outputs a stop signal.

The electric configuration of the impact rotation tool will now be described with reference to FIG. 2.

Figure 2:
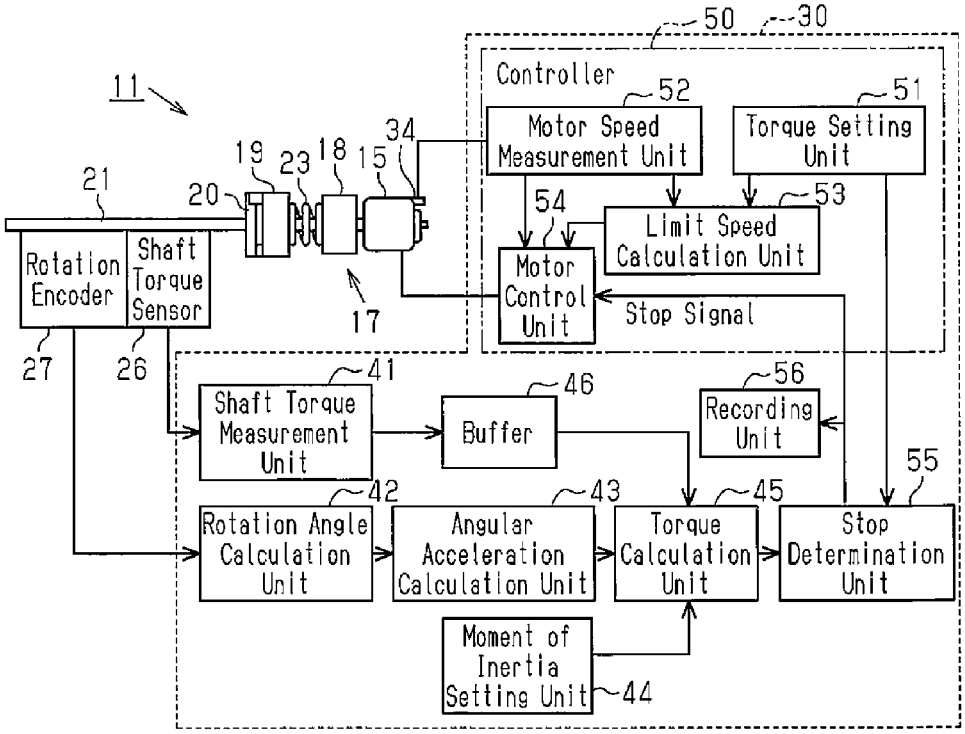
FIG. 2 is a block diagram showing the electric configuration of the impact rotation tool shown in FIG. 1.

As shown in FIG. 2, the impact rotation tool 11 includes the shaft torque sensor 26, the rotation encoder 27, and the control circuit 30.

The control circuit 30 includes the shaft torque measurement unit 41 and the rotation angle calculation unit 42. The shaft torque measurement unit 41 receives the output signal (torque detection signal S1) of the shaft torque sensor 26 and calculates the torque (measured torque) applied to the anvil 20 or the main shaft 21. In the present embodiment, the shaft torque sensor 26 and the shaft torque measurement unit 41 form a torque measurement unit. The rotation angle calculation unit 42 receives the output signal of the rotation encoder 27 and calculates the rotation angle of the main shaft 21.

The control circuit 30 also includes an angular acceleration calculation unit 43, a moment of inertia setting unit 44, and a torque calculation unit 45. In the present embodiment, the angular acceleration calculation unit 43, the moment of inertia setting unit 44, and the torque calculation unit 45 configure a tightening torque calculation unit. The angular acceleration calculation unit 43 calculates the angular acceleration based on the rotation angle calculated by the rotation angle calculation unit 42. The moment of inertia setting unit 44 sets the moment of inertia about the axis of the bit 24. The torque calculation unit 45 calculates the tightening torque value based on the measured torque and the angular acceleration. The value set as the moment of inertia may be the value of the moment of inertia in itself or a value in accordance with or in proportion to the moment of inertia. The control circuit 30 of the present embodiment includes a buffer 46 capable of sequentially accumulating waveform data of the measured torque for each impact calculated by the shaft torque measurement unit 41.

Further, the control circuit 30 includes a controller 50 that performs torque management, speed control, and the like for the motor 15. The controller 50 includes a torque setting unit 51 sets a target value for the tightening torque.

The torque setting unit 51 is electrically connected to limit speed calculation unit 53 and a stop determination unit 55. For example, the torque setting unit 51 includes a knob (not shown), which may be operated by the user, and a variable resistor (not shown). The resistance of the variable resistor is varied in accordance with the position of the knob, that is, the tightening torque set value (reference value) set by the user, to set a target torque To (refer to FIG. 5) for stopping the motor 15. For example, the torque setting unit 51 sets the target torque To within a range of ±10% from the tightening torque set value.

The controller 50 includes the motor speed measurement unit 52, which measures the rotation speed of the motor 15, the limit speed calculation unit 53, which calculates the limit speed of the motor 15, and a motor control unit 54, which controls the driving of the motor 15. The control circuit 30 includes a CPU and each of the units 52 to 54 is realized by a control program (software) executed by the CPU. The units 52 to 54 of the controller 50 may also be realized by integrated circuits such as ASICs (hardware). Alternatively, some of the units 52 to 54 may be realized by software, and the remaining one of the units 52 to 54 may be realized by hardware.

The motor speed measurement unit 52 measures the rotation speed of the motor 15 based on the output signal of the speed detector 34. The limit speed calculation unit 53 calculates the upper limit value of the rotation speed (limit speed) of the motor 15. The motor control unit 54 controls the driving of the motor 15 to limit the rotation speed of the motor to the limit speed or less when the trigger lever 29 is pulled. For example, when the target torque To is small, the motor control unit 54 limits the motor 15 to the limit speed or less that is less than the maximum speed even when the trigger lever 29 is pulled by the maximum amount.

The control circuit 30 includes a stop determination unit 55 that determines whether or not the torque value calculated by the torque calculation unit 45 has reached the target torque To. Further, the control circuit 30 includes a recording unit 56 that records the torque value when a stoppage occurs.

The operation of the impact rotation tool 11 in the present embodiment will now be described.

The user operates the torque setting unit 51 and sets the set torque in advance when, for example, tightening a fastener such as a bolt or a screw.

Figure 3:
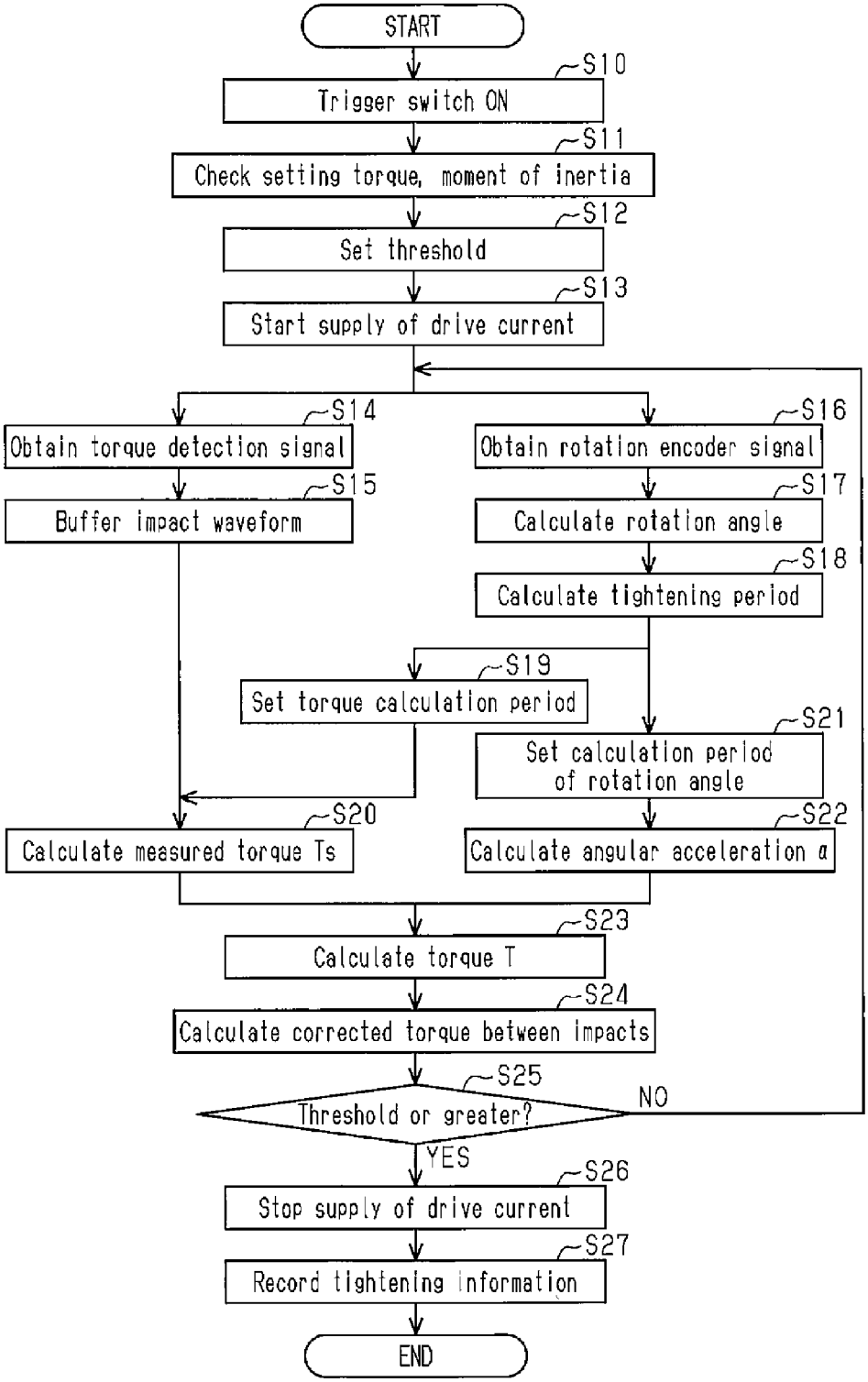
FIG. 3 is a flowchart illustrating one example of the operation of the impact rotation tool shown in FIG. 1.

Referring to FIGS. 1 to 3, when the trigger lever 29 is operated and the trigger switch (not shown) is activated (step S10), the controller 50 checks the set torque, which is set by the torque setting unit 51, and the moment of inertia, which is set by the moment of inertia setting unit 44 (step S11).

Further, the torque setting unit 51 of the controller 50 sets the target torque To (threshold) based on the set torque (step S12). Then, the motor control unit 54 of the controller 50 supplies the motor 15 with drive current and drives the motor 15 (step S13).

Then, the shaft torque measurement unit 41 of the control circuit 30 obtains the torque detection signal S1 from the shaft torque sensor 26 (step S14). The shaft torque measurement unit 41 constantly obtains the torque detection signal S1 when the motor 15 is driven. The shaft torque measurement unit 41 sequentially accumulates waveform data of the torque detection signal S1 for each impact in the buffer 46 (step S15).

Figures 4A, 4B, 4C:
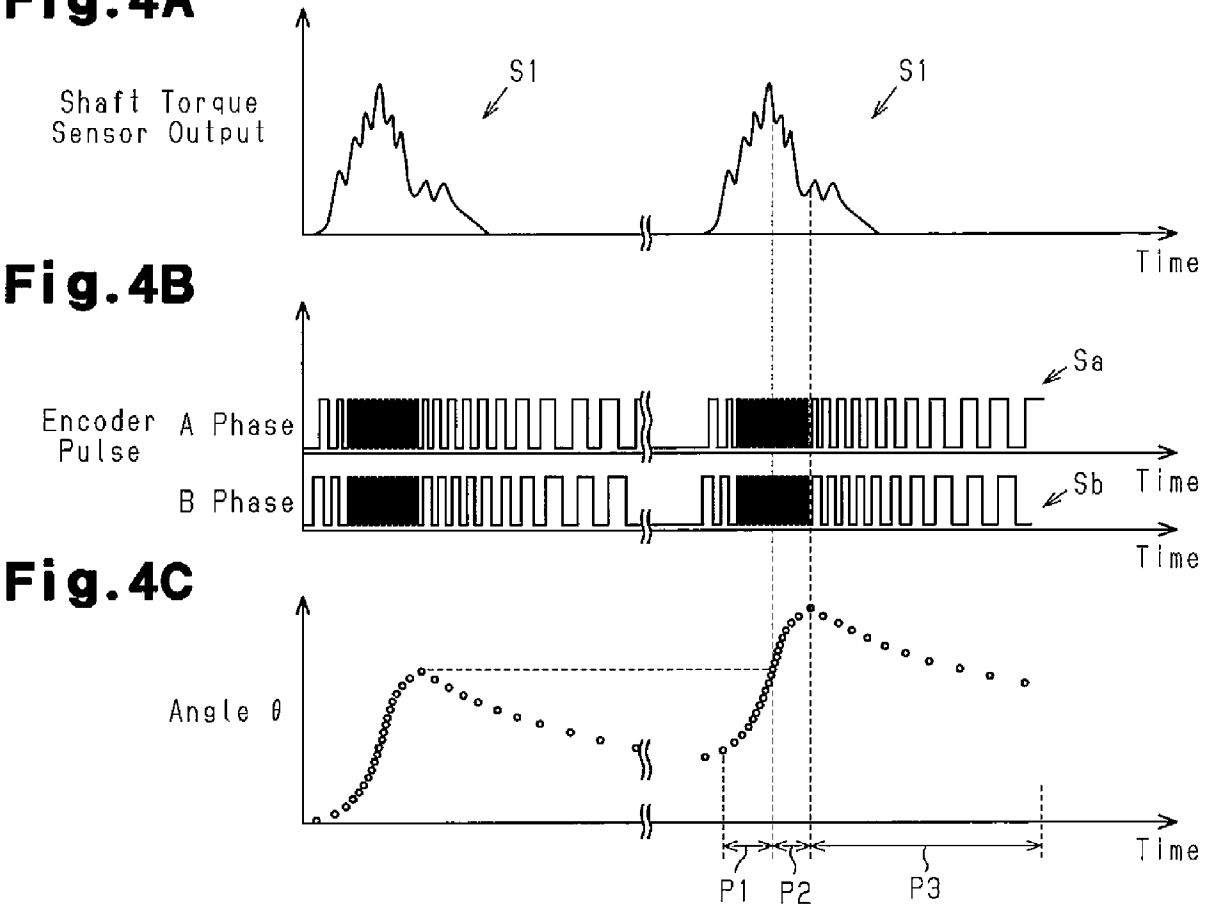
FIG. 4A is a graph showing the output of a shaft torque sensor.
FIG. 4B is a graph showing a pulse signal of a rotation encoder.
FIG. 4C is a graph showing angular changes resulting from the rotation of the shaft.

The rotation angle calculation unit 42 of the control circuit 30 obtains an A phase pulse signal Sa and a B phase pulse signal Sb detected by the rotation encoder 27 as rotation encoder signals (step S16). As shown in FIG. 4B, the pulse signals Sa and Sb are rectangular wave signals of which phases are shifted from each other by ninety degrees.

Then, the rotation angle calculation unit 42 calculates the rotation angle θ of the main shaft 21 (step S17). One example of a rotation angle change will now be described. As shown in FIG. 4C, the rotation angle θ of the main shaft 21 is increased by the impact force generated by the impact force generator 17. More specifically, when the anvil 20 is rotated and driven by a single strike (impact), rotation backlash between the anvil 20 and the bit 24 and rotation backlash between the bit 24 and the fastener are eliminated. Then, the fastener or the like is slightly twisted to increase the rotation angle θ of the main shaft 21 (period P1). Subsequently, the fastener is actually fastened to increase the rotation angle θ (period P2). When the fastener can no longer be tightened, the twisted fastener restores its original form, the rotation backlash starts to form, and the rotation angle θ decreases (Period P3).

Then, the angular acceleration calculation unit 43 calculates the tightening period (period P2) during which the fastener is actually tightened by impacts (step S18). The angular acceleration calculation unit 43 calculates the period corresponding to the difference between first and second timings during each strike (impact) as the tightening period (period P2). The first timing is when the rotation angle θ increased by the present impact force becomes the same as a maximum rotation angle obtained during the generation of the preceding impact force. The second timing is when the rotation angle θ increased by the present impact force becomes a maximum rotation angle obtained during the generation of the present impact force.

The torque calculation unit 45 sets a torque calculation period based on the tightening period (period P2) calculated by the angular acceleration calculation unit 43 (step S19). The torque calculation period is set to a length that allows the torque information (torque detection signal S1) used to calculate the tightening torque that is obtained. For example, the torque calculation period is set to the same period as period P2. When period P2 is short, the torque calculation period may be set to be longer than period P2. Alternatively, when period P2 is long, the torque calculation period P2 may be set to be shorter than period P2. Then, the torque calculation unit 45 obtains waveform data of the torque detection signal S1 from the buffer 46 in the torque calculation period (here, period P2). Based on the waveform data, the torque calculation unit 45 calculates the average torque value of period P2 as the measured torque Ts (step S20).

Further, the angular acceleration calculation unit 43 sets the rotation angle calculation period based on the tightening period (period P2) (step S21). The rotation angle calculation period is set to a length allowing the angular information (rotation angle θ), which is used to calculate the tightening torque, to be obtained. For example, the rotation angle calculation period is set as the same period as period P2. When period P2 is short, the rotation angle calculation period may be set to be longer than period P2. Alternatively, when period P2 is long, the rotation angle calculation period may be set to be shorter than period P2. Then, the angular acceleration calculation unit 43 calculates the angular acceleration α from the data of the rotation angle θ during the rotation angle calculation period (here, period P2) (step S22). In the present embodiment, the angular acceleration calculation unit 43 calculates the angular acceleration α using a quadratic approximation curve of the rotation angle θ in the range of period P2. The quadratic approximation curve of the rotation angle θ may be expressed by the following equation.

$$\theta = at^2 + bt + c \qquad \text{Equation 1}$$

Here, the angular acceleration α is derived by differentiating the rotation angle θ twice. Thus, the angular acceleration calculation unit 43 calculates the angular acceleration α from the following equation.

$$\alpha = \frac{d^2\theta}{dt^2} = 2a \qquad \text{Equation 2}$$

The angular acceleration α may change during the tightening period (period P2). However, to facilitate the calculation of the angular acceleration α, the angular acceleration α is derived as a constant value assuming that the average value of the angular acceleration α is obtained in period P2.

The angular acceleration α calculated by the angular acceleration calculation unit 43 is provided to the torque calculation unit 45. Then, the torque calculation unit 45 uses the measured torque Ts of period P2, the angular acceleration α of period P2, and the moment of inertia I set by the moment of inertia setting unit 44 (step S23).

$$T=Ts\times A-I\times\alpha\times B+C \quad \text{Equation 3}$$

Here, A, B, and C are adjustment correction coefficients. The correction coefficient A is a coefficient that corrects the error of the torque measured value caused by the difference in the static characteristics and dynamic characteristics of the shaft torque sensor 26 attached to the main shaft 21 and is generally a value of approximately 1 to 2. The correction coefficient B is a coefficient that corrects the error of the inertial torque caused by elastic deformation (twist deformation) of the bit 24 or the distal portion of the main shaft 21. The correction coefficient C is a coefficient that corrects the influence of viscosity during elastic deformation of the bit 24 or the distal portion of the main shaft 21. When the corrections are unnecessary, A=1, B=1, and C=0 may be used.

The tightening torque T calculated for each strike may decrease without monotonously increasing. Taking this into consideration, the torque calculation unit 45 calculates the tightening torque T (step S24). For example, the torque calculation unit 45 calculates the tightening torque T from the movement average of the data for two impacts or three impacts. However, when the difference of the two tightening torques T calculated between impacts is small and the tightening torque T increases monotonously, step S24 may be omitted and following step S25 may be performed.

Figure 5:
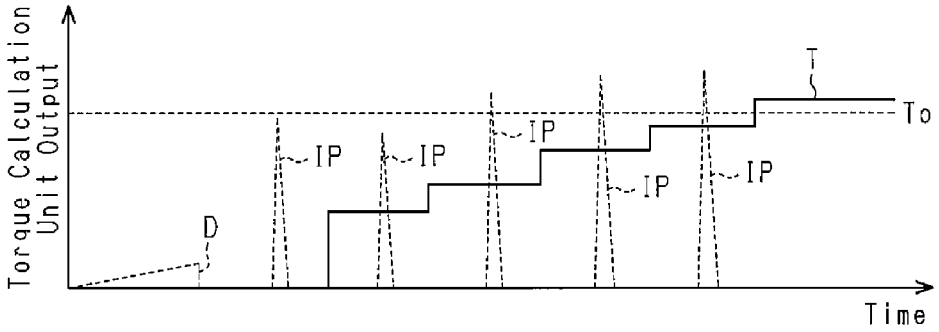
FIG. 5 is a graph showing the waveform of a voltage signal output from a torque calculation unit.

Changes in the tightening torque T will now be described. Referring to FIG. 5, immediately after the impact rotation tool 11 starts to tighten a fastener such as a screw or a bolt, the hammer 19 does not strike the anvil 20. Thus, the torque (output of shaft torque sensor 26) gradually increases as the fastening member tightens (indicated by D in FIG. 5). When the torque exceeds a certain value, the hammer 19 strikes the anvil 20 and repetitively generates an impact pulse IP. Whenever, the impact pulse IP is generated, the tightening torque T is calculated and updated. The calculated value of the tightening torque T is held until the following tightening torque T is calculated. Time is required to calculate the tightening torque T. Thus, the tightening torque T is calculated and updated with a delay of a predetermined time from when the impact pulse IP is generated. The tightening torque T gradually increases as the fastener tightens. Thus, the tightening torque T calculated by the torque calculation unit 45 is updated in a stepped manner whenever the impact pulse IP is generated.

In FIG. 3, when the tightening torque T is less than the target torque To (threshold) (step S25: NO), the stop determination unit 55 does not output a stop signal for the motor 15 and repeats processing from steps S14 and S16.

When the tightening torque T is greater than or equal to the target torque (step S25: YES), the stop determination unit 55 provides the motor control unit 54 with a stop signal for the motor 15. In response to the stop signal, the motor control unit 54 stops supplying drive current to the motor 15 (step S26). More specifically, the controller 50 stops driving the motor 15 when the tightening torque T calculated by the torque calculation unit 45 reaches the target torque To. As a result, the impact rotation tool 11 stops operating.

Subsequently, the stop determination unit 55 records tightening information such as the torque value or time used for tightening to the recording unit 56. The tightening information is recorded for each tightening task. Thus, for example, after a task is completed, the user may obtain the torque value and time for each tightening task.

The first embodiment has the advantages described below.

(1) The control circuit 30 calculates the tightening torque T based on the angular acceleration α and the measured torque T. Thus, when estimating the torque T from only the angular acceleration α, the tightening torque T may be calculated with high accuracy in comparison with when estimating the tightening torque T from only the measured torque Ts. An impact rotation tool such as an impact wrench or an impact driver is light compared to a tool such as an oil pulse tool or a nut runner that uses hydraulic pressure and generates impact load that changes relatively moderate manner. This provides a tool that is light and facilitates torque management.

(2) The torque calculation unit 45 calculates the tightening torque T from T=Ts×A−I×α×B+C (where A, B, and C are correction coefficients) using the measured torque Ts, the moment of inertia I, and the angular acceleration α. This ensures the calculation of the tightening torque T.

(3) The angular acceleration calculation unit 43 obtains an approximation curve of the rotation angle θ measured by the rotation encoder 27 and the rotation angle calculation unit 42 and differentiates the approximation curve twice to calculate the angular acceleration α. This allows the computation process performed by the angular acceleration calculation unit 43 to be simplified, and complicated computations do not have to be performed.

(4) The angular acceleration calculation unit 43 obtains the approximation curve of the rotation angle θ as a quadratic approximation curve and differentiates the rotation angle θ twice to calculate the angular acceleration α. Thus, there is no need to derive an approximation curve of a third order or greater. Further, the computation process performed by the angular acceleration calculation unit 43 may be simplified, and complicated computations do not have to be performed.

The first embodiment may be modified as described below.

In the first embodiment, the angular acceleration α is a constant value during the tightening period (period P2) but is not limited to a constant value. For example, an approximation curve of the rotation angle θ may be calculated during a longer period than the tightening period (period P2). In particular, by calculating the angular acceleration α to include information of the rotation angle θ outside period P2 (in particular, some of the rotation angles θ included in period P1), information of the rotation angle θ may be obtained even when the tightening period (period P2) is short. This contributes to improving the calculation accuracy of the tightening torque. Alternatively, the tightening torque T may be calculated in a period shorter than period P2. In particular, when the torque is small, period P2 is long. Thus, excluding the former half of period P2 (period of acceleration), the use of the latter half of period P2 (period of deceleration) to obtain the approximation curve may contribute to improving the calculation accuracy.

In the first embodiment, although not particularly mentioned, for example, the projections 20*a* of the anvil 20 may be elastic bodies to reduce torque changes caused by the impact when the anvil 20 and the hammer 19 come into contact. In this case, the shaft torque measurement unit 41 may derive the peak value in a predetermined period as the measured torque Ts. As a result, the angular acceleration α may be expected to become extremely small. Thus, it can be assumed that the tightening torque T is almost equal to the measured torque Ts.

The average value of the measured value of the angular acceleration during a predetermined period, for example, the tightening period (period P2), may be used as the angular acceleration α.

In the first embodiment, the approximation curve of the rotation angle θ is derived as a quadratic approximation curve but may be derived as an approximation curve of a third order or greater. An example of a case in which a fourth order approximation curve of the rotation angle θ is derived will now be described.

A fourth order approximation curve of the rotation angle θ in the range of period P2 is expressed by the next equation.

$$\theta = at^4 + bt^3 + ct^2 + dt + e \qquad \text{Equation 4}$$

Here, the angular acceleration α is derived by differentiating the rotation angle θ twice. Thus, the angular acceleration calculation unit 43 calculates the angular acceleration α from the following equation.

$$\alpha = \frac{d^2\theta}{dt^2} = 12at^2 + 6bt + 2c \qquad \text{Equation 5}$$

In this manner, by using a high order approximation curve of a third order or greater, a change in the angular acceleration α may be obtained with high accuracy. This allows the angular acceleration α to be obtained with higher accuracy.

Figure 6:
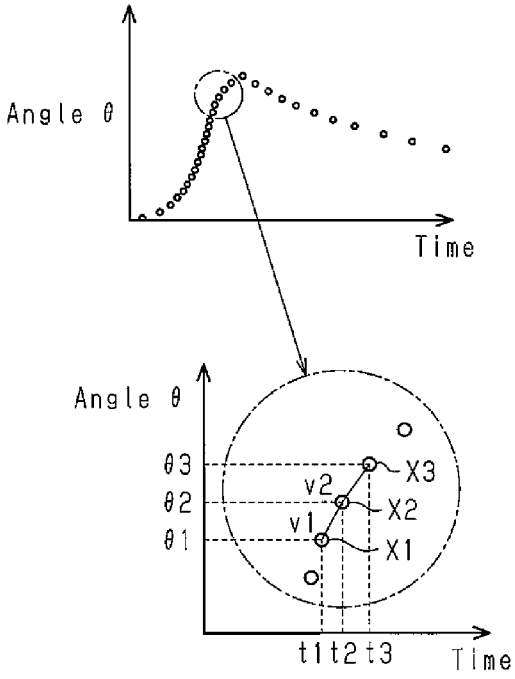
FIG. 6 is a schematic diagram illustrating how to calculate the angular acceleration of the impact rotation tool in a further example.

An approximation equation (approximation curve of rotation angle θ) does not necessarily have to be used to calculate the angular acceleration α. For example, referring to FIG. 6, the speed v1 between two points X1 and X2 and the speed v2 between two points X2 and X3 may be used to calculate a speed change. Specifically, the angular acceleration α may be calculated from the following equation.

$$\alpha = \frac{v2 - v1}{\frac{t3 + t2}{2} - \frac{t2 + t1}{2}} = \frac{\frac{\theta 3 - \theta 2}{t3 - t2} - \frac{\theta 2 - \theta 1}{t2 - t1}}{\frac{t3 + t2}{2} - \frac{t2 + t1}{2}} \qquad \text{Equation 6}$$

The motor 15 may be a DC motor or an AC motor other than a brush motor or a brushless motor.

The drive source of the impact rotation tool 11 is not limited to a motor and may be, for example, a solenoid. Further, the drive source does not have to be driven by electric power like a motor or a solenoid and may be driven by hydraulics.

The impact rotation tool 11 may be a non-rechargeable AC impact rotation tool or a pneumatic impact rotation tool.

A strain gauge may be used as the torque sensor. In this case, the strain gauge is fixed to the main shaft 21, and, for example, a device such as a slip ring may be used to obtain torque data through non-contact communication.

The impact rotation tool does not have to be of a hand-held type.

Figure 7:
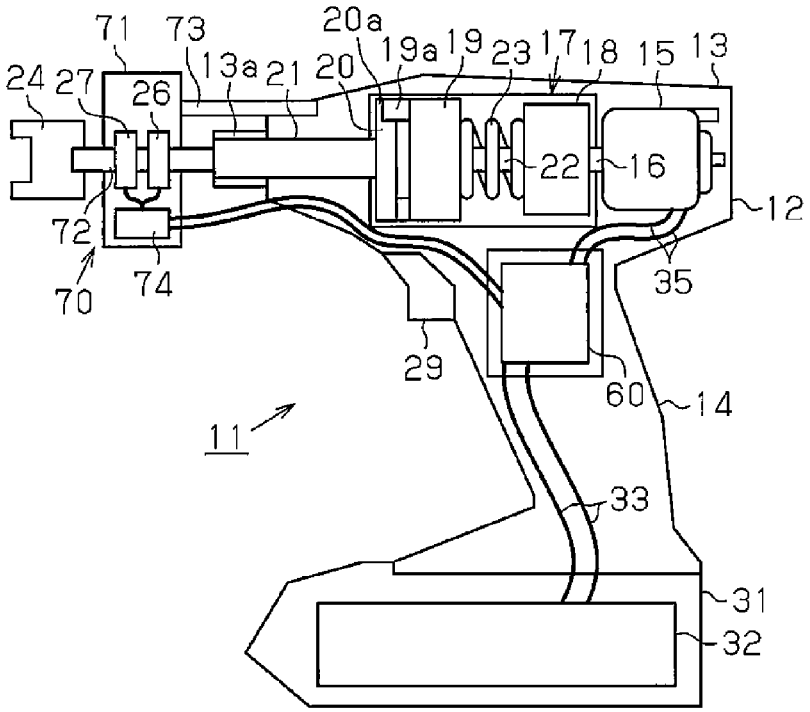
FIG. 7 is a schematic cross-sectional view showing an attachment that is attachable to the impact rotation tool of FIG. 1.
Figure 8:
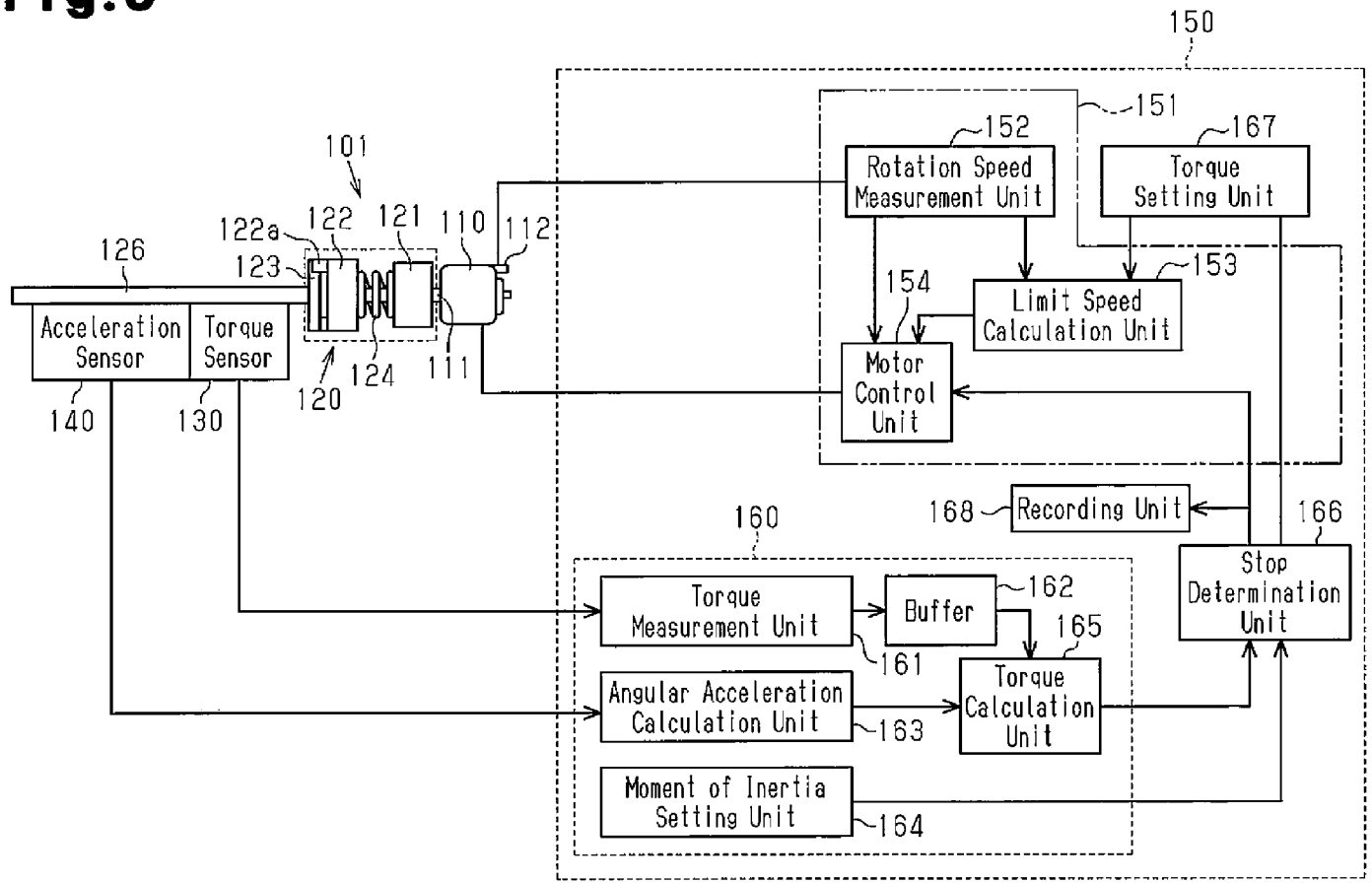
FIG. 8 is a block diagram showing the electric configuration of a second embodiment of an impact rotation tool.

As shown in FIG. 7, an attachment 70 including the shaft torque sensor 26, the rotation encoder 27, and a control circuit 74 implementing some of the functions of the control circuit 30 may be attached in a removable manner to the impact rotation tool 11. The attachment 70 is used as, for example, a distal end attachment of the impact rotation tool 11. The attachment 70 includes a housing 71, which serves as a case that can be coupled to the main body (housing 12) of the impact rotation tool 11, and an output shaft 72, which extends through the housing 71. One end of the output shaft 72 is coupled to the chuck 13*a* of the impact rotation tool 11, and the rotation of the main shaft 21 is transmitted to the output shaft 72. The other end of the output shaft 72 is coupled to the bit 24. A fastener 73 fastens the housing 71 to the barrel 13 of the impact rotation tool 11 so that the housing 71 does not rotate integrally with the output shaft 72.

The shaft torque sensor 26 and the rotation encoder 27 are coupled to the output shaft 72. The shaft torque sensor 26 and the rotation encoder 27 are electrically connected to the control circuit 74 accommodated in the housing 71. The control circuit 74 includes the shaft torque measurement unit 41, the rotation angle calculation unit 42, the angular acceleration calculation unit 43, the moment of inertia setting unit 44, the torque calculation unit 45, the buffer 46, the stop determination unit 55, and the recording unit 56 that are used in the first embodiment. The control circuit 74 is electrically connected to the control circuit 60 that is accommodated in the impact rotation tool 11. The control circuit 60 includes the controller 50 of the first embodiment. For example, when the tightening torque T calculated by the stop determination unit 55 of the control circuit 74 reaches the target torque To, the control circuit 74 provides the motor control unit 54 of the control circuit 60 with a stop signal. Further, the set torque information, which is set by the torque setting unit 51, is provided from the controller 50 of the impact rotation tool 11 to the control circuit 74.

The illustrated configuration of the attachment 70 is one example. The attachment may be configured so that an attachment including at least one of the rotation encoder 27 and the shaft torque sensor 26 provides the control circuit 30 of the impact rotation tool 11 with information of the rotation angle and torque.

The first embodiment may be combined with any of the modifications described above.

A second embodiment of an impact rotation tool will now be described with reference to FIGS. 8 to 17.

Like the first embodiment, the impact rotation tool 101 of the second embodiment is of a hand-held type and may be held with a single hand. Further, the impact rotation tool 101 may be used as an impact driver or an impact wrench used to fasten a fastener such as a bolt or a nut.

The impact rotation tool 101 includes an impact force generation unit, an output shaft 126, a torque sensor 130 serving as a first measurement unit, an acceleration sensor 140 serving as a second measurement unit, and a torque computation unit 160.

Figure 9A:
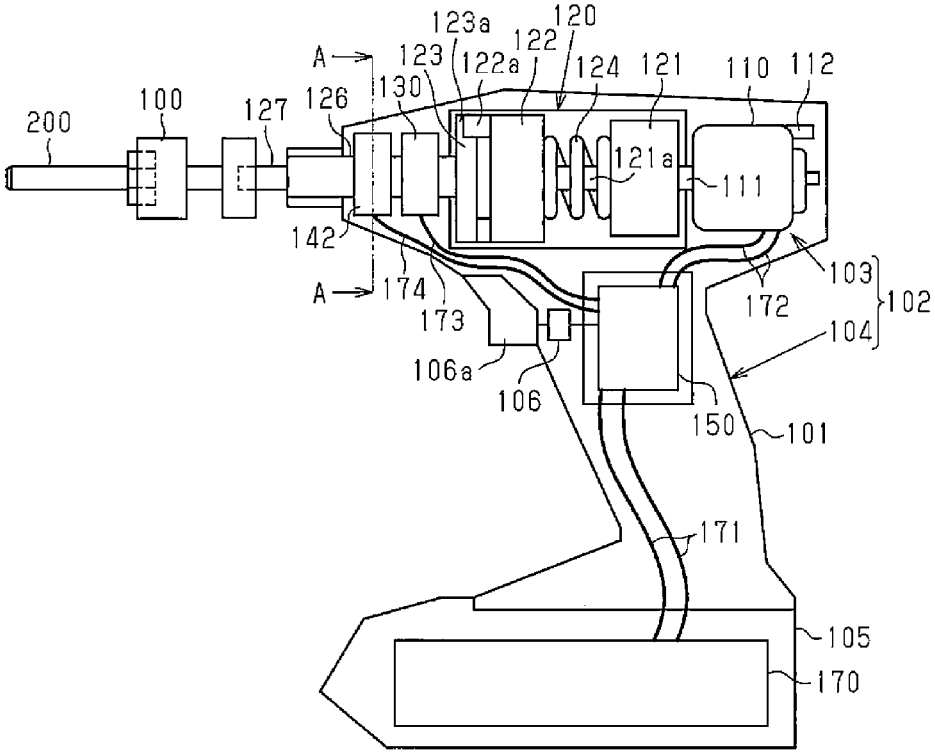
FIG. 9A is a schematic cross-sectional side view of the impact rotation tool shown in FIG. 8.

As shown in FIG. 9, the impact rotation tool 101 includes a main body 102. The main body 102 includes a tubular barrel 103 and a grip 104, which projects from the circumferential surface of the barrel 103 in a direction intersecting the axis of the barrel 103 (lower direction in FIG. 9A). A battery pack 105, which accommodates a rechargeable battery 170 in a resin case, is coupled in a removable manner to the lower portion of the grip 104. When the battery pack 105 is coupled to the grip 104, power is supplied to a control circuit 150, which includes a torque computation unit 160 (refer to FIG. 8), and a motor 110 (drive source) from the rechargeable battery 170 through a power line 171. The impact rotation tool 101 is operated by the power supplied from the rechargeable battery 170.

The impact force generation unit includes an impact mechanism 120 that generates a pulsed impact force from the rotation force of a rotation shaft 111 of the motor 110 and applies the impact force to the output shaft 126.

The motor 110 is a DC motor such as a brush motor or a brushless motor. The rotation shaft 111 of the motor 110 coincides with the axis of the barrel 103. The motor 110 is accommodated in a rear portion (right side as viewed in FIG. 9A) of the barrel 103 so that the rotation shaft 111 faces the front side (left side as viewed in FIG. 9A) of the barrel 103.

The motor 110 is supplied with drive current from the control circuit 150 through a power line 172. The control circuit 150 controls the rotation speed and rotation direction of the motor 110.

The impact mechanism 120 intermittently applies pulsed impact force to the output shaft 126. The impact mechanism 120 includes a speed reduction mechanism 121, a hammer 122, an anvil 123, and a coil spring 124.

The speed reduction mechanism 121 is coupled to the rotation shaft 111 of the motor 110 and reduces the rotation of the motor 110 by a predetermined speed reduction ratio. High-torque rotation force obtained by the speed reduction performed by the speed reduction mechanism 121 is transmitted to the hammer 122.

The hammer 122 is rotatable relative to a drive shaft 121*a* of the speed reduction mechanism 121 and movable in the front-rear direction along the drive shaft 121*a*. The elastic force of a coil spring 124, through which the drive shaft 121*a* extends, urges and pushes the hammer 122 toward the front side against the anvil 123, which is located at the rear portion of the output shaft 126. The front surface of the hammer 122 includes a projection 122*a* that strikes a projection 123*a* projecting from the anvil 123 in the radial direction. Rotation of the drive shaft 121*a* when the projection 122*a* of the hammer 122 is in contact with the projection 123*a* of the anvil 123 integrally rotates the hammer 122 and the anvil 123. This rotates the output shaft 126, which is arranged integrally with the anvil 123. In the second embodiment, the impact mechanism 120 generates pulsed impact force from the rotation of the motor 110. However, the current driving the motor 110 may be controlled to generate pulsed impact force from the rotation force of the motor 110. In this case, a motor control unit 154 that controls the rotation of the motor 110 configures the impact force generation unit.

When tightening and loosening a fastener, the torque applied to the output shaft 126 increases. When torque of a predetermined value or greater is applied between the hammer 122 and the anvil 123, the output shaft 126 stops rotating. Then, the hammer 122 moves toward the rear along the drive shaft 121*a* of the speed reduction mechanism 121 as the hammer 122 compresses the coil spring 124. As the hammer 122 moves toward the rear and away from the anvil 123, the projection 122*a* is separated from the projection 123*a*. As a result, the urging force of the coil spring 124 moves the hammer 122 forward as the hammer 122 rotates freely. When the hammer 122 is rotated by a predetermined angle, the projection 122*a* of the hammer 122 strikes the projection 123*a*. This applies impact force from the hammer 122 to the anvil 123. Such an operation is repeated to intermittently apply impact force to the output shaft 126 so that the fastener can be tightened or loosened with a larger torque.

Figure 9B:
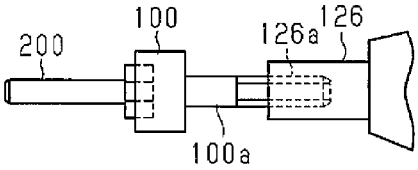
FIG. 9B is a side view showing a modified example of the impact rotation tool shown in FIG. 8.

The output shaft 126 is arranged integrally with the anvil 123, which is rotated when struck by the hammer 122. The output shaft 126 is rotatably coupled to the front end of the barrel 103 and coaxial with the barrel 103. The output shaft 126 includes a distal end that projects out of the front end of the barrel 103. A square rod 127 is arranged on the distal end of the output shaft 126. The square rod 127 serves as a chuck that receives a bit 100 corresponding to the performed task. The bit 100 is attached to the square rod 127. The impact rotation tool 101 is used as an impact driver or an impact wrench. As shown in FIG. 9B, a chuck including a hexagonal hole 126*a* may be used in lieu of the square rod. In this case, a hexagonal shank 100*a* of the bit 100 is inserted into the hexagonal hole 126*a* of the output shaft 126 to attach the bit 100 to the output shaft 126. The output shaft 126 functions as a shaft that transmits pulsed torque, which is generated by the impact force from the impact force generation unit, to the bit 100.

The torque sensor 130 is, for example, a magnetostrictive sensor, detects the strain generated at the output shaft 126 in a non-contact manner when torque is applied to the output shaft 126, and generates an electric signal proportional to the level of the strain. The electric signal indicates the torque (measured torque) applied to the output shaft 126 and is provided to the control circuit 150 via a wire 173.

Figure 10A:
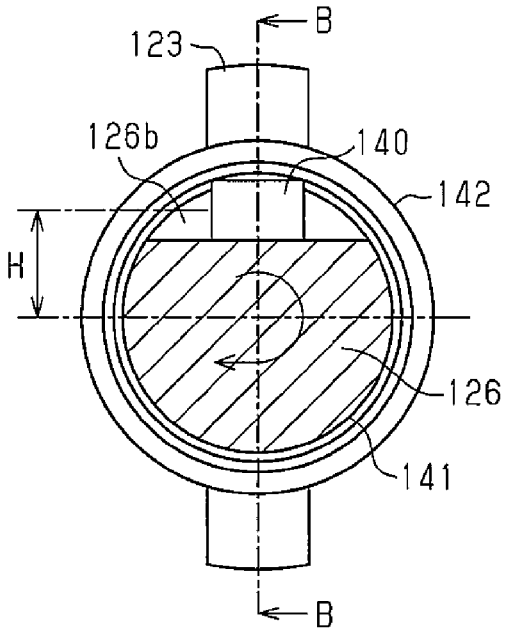
FIG. 10A is a cross-sectional view taken along line A-A in FIG. 9A.
Figure 10B:
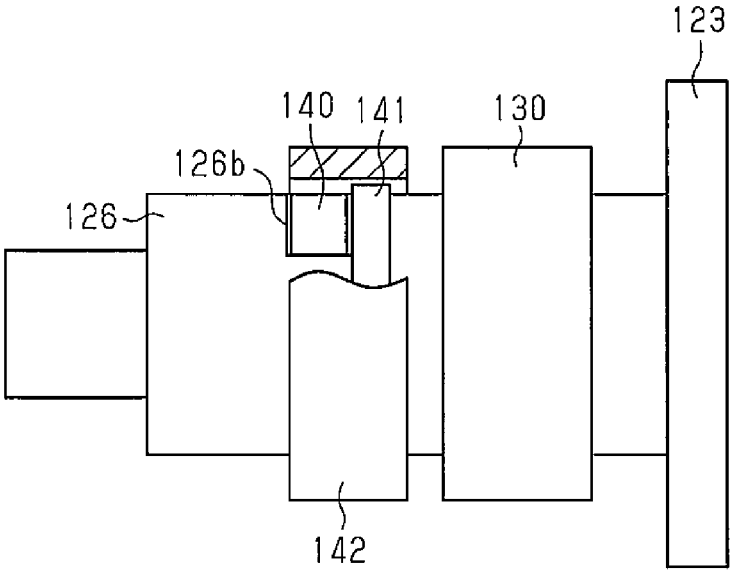
FIG. 10B is a cross-sectional view taken along line B-B in FIG. 10A.
Figure 11:
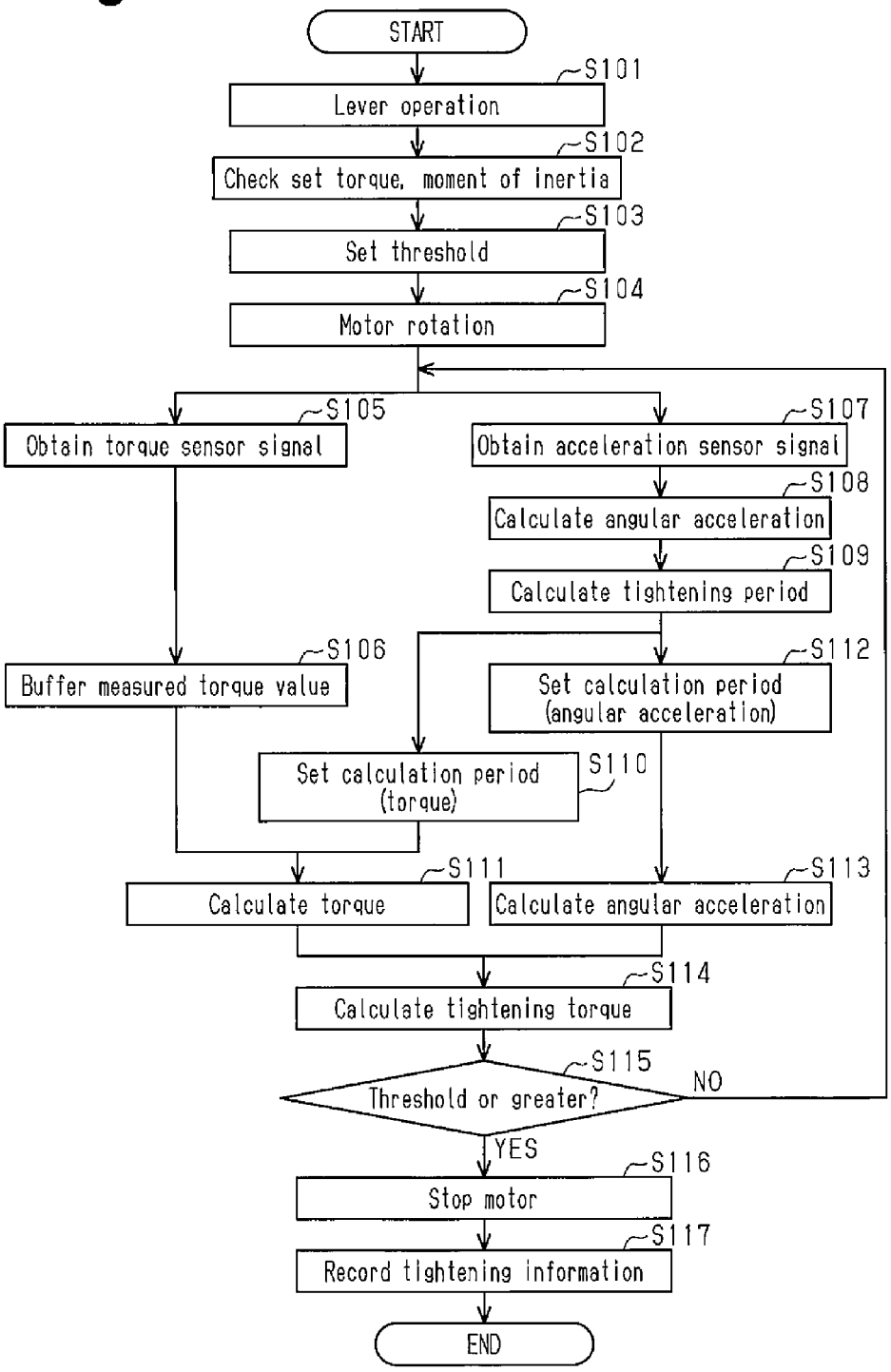
FIG. 11 is a flowchart illustrating one example of the operation of the impact rotation tool in the second embodiment.

As shown in FIGS. 10A and 10B, the acceleration sensor 140, which is arranged in a groove 126*a* formed by D-cutting a portion of the cylindrical output shaft 126, measures the acceleration component in at least the circumferential direction. In addition to an acceleration component in the circumferential direction, the acceleration sensor 140 may measure an acceleration component in a radial direction.

The acceleration sensor 140 is located on the output shaft 126 that is rotated by the impact mechanism 120. Communication coils 141 and 142 are used to supply the acceleration sensor 140 with power and receive the measured value of the acceleration sensor 140. The communication coil 141 is fixed to the circumferential surface of the output shaft 126. The communication coil 142 is arranged facing the communication coil 141. When alternating current flows to the communication coil 142 through a power line 174 under the control of the control circuit 150, current flows to the communication coil 141 due to mutual induction. The acceleration sensor 140 rectifies and smoothens the current flowing through the communication coil 141 to obtain operational power that is stored in, for example, a capacitor (not shown). Further, the acceleration sensor 140 provides the communication coil 141 with a pulse signal having a frequency that differs from that of the alternating current supplied from the control circuit to transmit the measured value to the control circuit 150 through the communication coil 142 and the power line 174. This allows the control circuit 150 to supply the acceleration sensor 140 with power in a non-contact manner and receive the measured value of the acceleration sensor 140 in a non-contact manner.

The control circuit 150 has a rotation control function that controls the rotation produced by the motor 110 based on an operation signal output from an operation switch 106 in accordance with a pulling operation of the trigger lever 106*a* arranged in the grip 104. Further, the control circuit 150 has a torque control function for obtaining the tightening torque from the measured values of the torque sensor 130 (first measurement unit) and the acceleration sensor 140 (second measurement unit) and stopping the motor 110 when the tightening torque reaches the target torque.

The control circuit 150 includes a motor controller 151, a torque computation unit 160, a stop determination unit 166 serving as a control unit, a torque setting unit 167, and a recording unit 168. The motor controller 151 includes a rotation speed measurement unit 152, a limit speed calculation unit 153, and the motor control unit 154. The torque computation unit 160 includes a torque measurement unit 161, a buffer 162, an angular acceleration calculation unit 163, a moment of inertia setting unit 164, and a torque calculation unit 165. The motor controller 151, the torque measurement unit 161, the angular acceleration calculation unit 163, the torque calculation unit 165, and the stop determination unit 166 are realized by, for example, the computation functions of a microcomputer when the microcomputer executes control programs.

The torque setting unit 167, which is electrically connected to the motor controller 151 and the stop determination unit 166, varies the resistance of a variable resistor in accordance with the operation position of an operation knob (not shown). The torque setting unit 167 provides the motor controller 151 and the stop determination unit 166 with a signal corresponding to the set tightening torque value set by the user (e.g., voltage signal corresponding to resistance of variable resistor) as a target torque T0.

The rotation speed measurement unit 152 measures the rotation speed of the motor 110 based on a signal corresponding to the speed provided from a speed detector 112, which is located on the motor 110. The speed detector 112 is, for example, a frequency generator that generates a frequency signal having a frequency proportional to the rotation speed of the motor 110.

The limit speed calculation unit 153 calculates the upper limit value (limit speed) of the rotation speed when the trigger lever 106*a* is operated in accordance with the rotation speed measured by the rotation speed measurement unit 152 and the target torque set by the torque setting unit 167.

The motor control unit 154 controls and drives the motor 110 based on an operation signal input from the operation switch 106 in accordance with the pulling of a trigger lever 106*a* so that the rotation speed of the motor 110 is less than or equal to the limit speed. When the target torque (target value of tightening torque) is set to be small, the limit speed may be lower than the maximum speed of the motor 110. In such a case, even when the trigger lever 106*a* is pulled by a maximum amount, the rotation speed of the motor 110 is limited to the limit speed that is lower than the maximum speed. Further, when performing a tightening task, if the tightening torque reaches the target torque and the motor control unit 154 receives a stop signal from the stop determination unit, the motor control unit 154 stops the rotation of the motor 110.

The torque measurement unit 161 measures the torque applied to the output shaft 126 based on the output signal from the torque sensor 130.

The buffer 162 stores the value of the torque measured by the torque measurement unit 161. The buffer receives new data from the torque measurement unit 161 and stores the new data that is overwritten on old data. That is, the buffer 162 stores the measured value of the torque for a predetermined period from the present time.

The angular acceleration calculation unit 163 obtains the angular acceleration by dividing the acceleration in the circumferential direction measured by the acceleration sensor 140 by the distance from the center position of the output shaft 126 to the coupling position of the acceleration sensor 140.

The moment of inertia setting unit 164 is used to set the moment of inertia I1 at the portion distal from the acceleration sensor 140 coupled to the output shaft 126. The portion distal from the acceleration sensor 140 coupled to the output shaft 126 includes the portion of the output shaft 126 located toward the distal side from the coupling portion of the acceleration sensor 140 and the bit 100 attached to the square rod 127 on the distal end of the output shaft 126.

The torque calculation unit 165 calculates the torque for tightening the fastener based on the value of the torque measured by the torque sensor 130. The measured value of the torque sensor 130 is the sum of the fastener tightening torque and the inertial torque at the portion of the output shaft 126 located at the distal side of where the torque sensor 130 is coupled. The inertial torque at the portion of the output shaft 126 located at the distal side of where the torque sensor 130 is coupled may be obtained from the moment of inertia of the portion of the output shaft 126 located at the distal side of where the torque sensor 130 is coupled and the bit 100 attached to the distal end of the output shaft 126 and the angular acceleration of the output shaft 126. When the impact rotation tool 101 is used at a construction site or a plant, the type of fastener that is tightened is determined by a certain degree and the used bit 100 is also determined in accordance with the tightened fastener. Thus, in accordance with, for example, the bit 100, the user obtains the moment of inertia of the portion of the output shaft 126 at the distal side of the portion where the torque sensor 130 is coupled and the tool attached to the distal end of the output shaft 126. Then, the user sets the value of the moment of inertia in advance to the moment of inertia setting unit 164.

Accordingly, the torque calculation unit 165 obtains the tightening torque from the value of the torque measured by the torque sensor 130, the angular acceleration of the output shaft 126 obtained from the measured value of the acceleration sensor 140, and the moment of inertia set by the moment of inertia setting unit 164. Here, the measured torque value of the torque sensor 130 is represented by T1, the angular acceleration obtained by the measured value of the acceleration sensor 140 is represented by a1, the set value of the moment of inertia is represented by I1, and correction coefficients are represented by A, B, and C, the torque calculation unit 165 calculates the tightening torque T2 using the following equation.

$$T2=T1\times A-I1\times a1\times B+C \qquad \text{Equation 7}$$

Correction coefficient A is a coefficient that corrects the error of the measured torque value caused by the difference in the static characteristics and dynamic characteristics of the torque sensor 130 attached to the output shaft 126 and is generally a value of approximately 1 to 2. Correction coefficient B is a coefficient that corrects the error of the inertial torque caused by elastic deformation (twisting) of the distal portion of the output shaft 126 and the bit 100 attached to the distal end of the output shaft 126. Correction coefficient C is a coefficient that corrects the influence of viscosity during elastic deformation of the distal portion of the output shaft 126 and the bit 100 attached to the distal end of the output shaft 126.

The stop determination unit 166 compares the tightening torque T2 calculated by the torque calculation unit 165 with the target torque T0 (threshold) obtained from the set value of the torque setting unit 167. When the tightening torque T2 becomes greater than or equal to the target torque T0, the stop determination unit 166 outputs a stop signal to the motor control unit 154.

The recording unit 168 records the determination result of the stop determination unit 166.

A tightening operation performed with the impact rotation tool 101 of the second embodiment will now be described with reference to the flowchart of FIG. 2.

The user pulls the trigger lever 106*a* (step S101). An operation signal corresponding to the operation amount of the trigger lever 106*a* is provided from the operation switch 106 to the control circuit 150. When the control circuit 150 receives an operation signal from the operation switch 106, the control circuit 150 reads the set value of the tightening torque from the torque setting unit 167 and reads the set value of the moment of inertia from the moment of inertia setting unit 164 (step S102). The stop determination unit 166 of the control circuit 150 sets the threshold of the tightening torque, namely, the target torque T0, based on the set value of the tightening torque read from the torque setting unit 167 (step S103).

Then, the motor control unit 154 of the motor controller 151 supplies the motor 110 with drive current in accordance with the operation signal from the operation switch 106 and produces rotation with the motor 110 (step S104).

When the motor 110 produces rotation, the torque measurement unit 161 obtains a signal from the torque sensor 130 in predetermined measurement cycles and computes the torque applied to the output shaft 126 from the signal (step S105). Then, the torque measurement unit 161 stores the computed torque value (measured torque) in the buffer (step S106).

The angular acceleration calculation unit 163 obtains a measurement signal from the acceleration sensor 140 in predetermined measurement cycles (step S107). The angular acceleration calculation unit 163 obtains the acceleration in the circumferential direction from the measurement signal obtained from the acceleration sensor 140. Then, the angular acceleration calculation unit 163 divides the acceleration in the circumferential direction by the distance from the axis of the output shaft 126 to the coupling position of the acceleration sensor 140 to obtain the angular acceleration (step S108).

The angular acceleration calculation unit 163 obtains the tightening period during which a fastener 200 is tightened (step S109). For example, the tightening period may be the time when the angular acceleration becomes the maximum in the rotation stop direction of the motor 110. Alternatively, the tightening period may be the time that is a predetermined time before or after when the angular acceleration becomes the maximum in the rotation stop direction of the motor 110. As another option, the tightening period may be a predetermined period (fixed period) including the time when the angular acceleration becomes the maximum in the rotation stop direction of the motor 110.

Figures 12A, 12B, 12C:
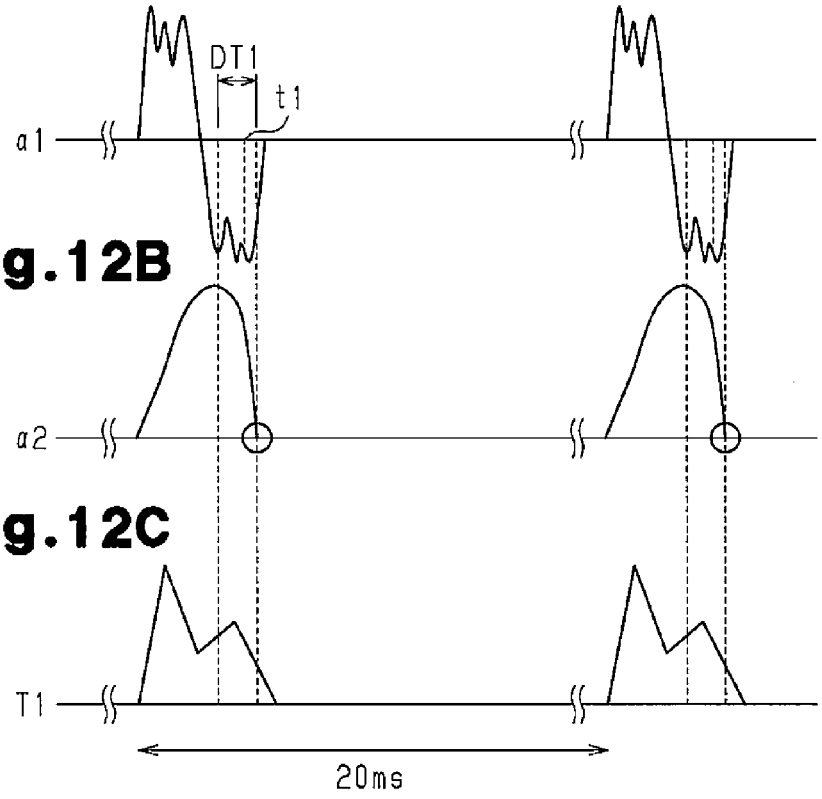
FIG. 12A is a flowchart illustrating one example of the operation of the impact rotation tool in the second embodiment.
FIG. 12B is a flowchart illustrating one example of the operation of the impact rotation tool in the second embodiment.
FIG. 12C is a flowchart illustrating one example of the operation of the impact rotation tool in the second embodiment.

FIGS. 12A to 12C are waveform diagrams showing the measurement results of the torque sensor 130 and the acceleration sensor 140 during a tightening task. FIG. 12A is a waveform diagram of the acceleration $\alpha 1$ in the circumferential direction measured by the acceleration sensor 140. FIG. 12B is a waveform diagram of the acceleration $\alpha 2$ in the radial direction measured by the acceleration sensor 140. FIG. 12C is a waveform diagram of the measured torque value T1 of the torque sensor 130. For example, when the measurement results of the acceleration $\alpha 1$ in the circumferential direction is as shown in FIG. 12A, the angular acceleration calculation unit 163 obtains a fixed period DT (e.g., 200 μs) including the time (time t1) when the angular acceleration becomes the maximum in the rotation stop direction of the motor 110 as the tightening period (refer to FIG. 12A).

As described above, the angular acceleration calculation unit 163 may determine the time (time t1) when the angular acceleration becomes the maximum in the rotation stop direction of the motor 110 as the tightening period and calculate the angular acceleration during the tightening period. Alternatively, the angular acceleration calculation unit 163 may determine the time that is a predetermined time before or after the time (time t1) when the angular acceleration becomes the maximum in the rotation stop direction as the tightening period and calculate the angular acceleration during the tightening period.

The angular acceleration at a predetermined time after when the angular acceleration becomes the maximum in the rotation stop direction of the motor 110 is calculated in the following manner. When the projection 123*a* of the anvil 123 strikes the projection 122*a* of the hammer 122, an impact force is applied to the anvil 123. This rotates the bit 100, which is attached to the output shaft 126. Here, the projection 122*a* that strikes the projection 123*a* of the anvil 123 may rebound and move away from the anvil 123. In this case, the hammer 122 may catch up with the anvil 123 before the anvil 123 stops and the projection 122*a* may strike the projection 123*a* again. It is predicted that the projection 122*a* of the hammer 122 will catch up with and restrike the anvil 123, for example, 1 to 100 microseconds after when the angular acceleration becomes the maximum in the rotation stop direction. Accordingly, the tightening torque is calculated using the angular acceleration when the hammer 122 restrikes the anvil 123. This allows the tightening torque to be calculated with a higher accuracy.

The torque calculation unit 165 sets the calculation period of the torque from the tightening period DT1 obtained in step S109 (step S110). The torque calculation unit 165 reads the measured values during the calculation period set in step S110 from the buffer 162 and, for example, obtains the average of the read average values to obtain the measured value T1 of the torque (step S111).

The angular acceleration calculation unit 163 sets the calculation period of the angular acceleration from the tightening period DT1 obtained in step S109 (step S112) and obtains the average of the angular acceleration during the calculation period set in step S112 to calculate the measured value a1 of the angular acceleration (step S113).

When the torque T1 and the angular acceleration a1 are calculated, the torque calculation unit 165 assigns the calculation results of the torque T1 and the angular acceleration a1 and the moment of inertia I1, which is set in the moment of inertia setting unit 164, in equation 7 and calculates the tightening torque T2 (step S114).

Figure 14:
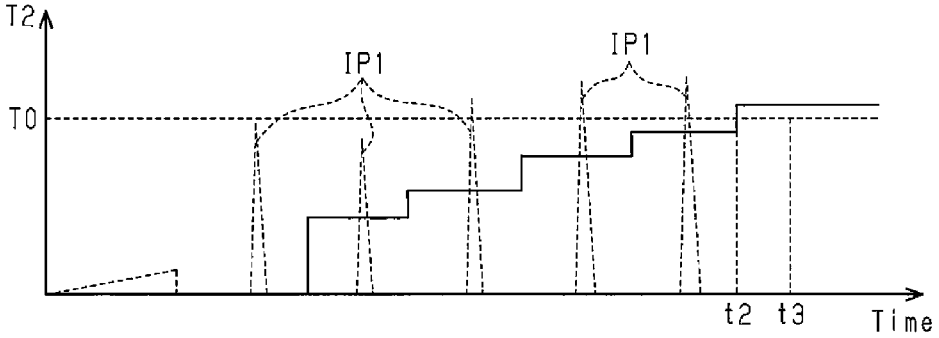
FIG. 14 is a timing chart showing changes in the tightening torque of the impact rotation tool in the second embodiment.

When the tightening torque T2 of the fastener 200 is calculated, the stop determination unit 166 compares the tightening torque T2 with the target torque T0 (threshold) (step S115). FIG. 14 indicates temporal changes in the tightening torque T2. Whenever the hammer 122 strikes the anvil 123, the tightening torque T2 increases in a stepped manner. The broken line IP1 in FIG. 14 indicates the intermittent impact that the hammer 122 applies to the anvil 123.

When determining in step S115 that the tightening torque T2 is less than the target torque T0 (NO in step S115), the control circuit 150 returns to steps S105 and S107 are performs the above processes again.

At time t2 in FIG. 14, when the torque T0 is greater than or equal to the target torque T0 (YES in step S115), the stop determination unit 166 outputs the stop signal to the motor control unit 154. When the stop signal is input, the motor control unit 154 stops the supply of current to the motor 110 at time t3 and stops the rotation of the motor 110 (step S116). This allows the tightening torque to be managed. Further, the stop determination unit 166 outputs a stop signal, records the information of the tightening torque T2 to the recording unit 168 (step S117), and ends the tightening operation.

The second embodiment has the advantages described below.

(1) The impact rotation tool 101 includes the motor 110, the impact mechanism 120 (impact force generation unit), the output shaft 126, the torque sensor 130 (first measurement unit), the acceleration sensor 140 (second measurement unit), and the torque computation unit 160. The impact force generation unit generates a pulsed impact force. The bit 100 that performs tightening is attached to the output shaft 126. The output shaft 126 is rotated by the impact force generated by the impact force generation unit. The torque sensor 130 measures the torque applied to the output shaft 126. The acceleration sensor 140 measures the acceleration of the output shaft 126 in the circumferential direction. The torque computation unit 160 uses the measured value of the acceleration sensor 140 to obtain the inertial torque of the output shaft 126 and the bit 100 attached to the output shaft 126. Then, the torque computation unit obtains the tightening torque based on the measured torque value of the torque sensor 130.

In this structure, the torque computation unit 160 measures the tightening torque with further accuracy as compared to when obtaining the tightening torque with only the measured value of the torque sensor without taking the inertial torque into consideration. The second measurement unit is not limited to the acceleration sensor 140 that measures the acceleration in the circumferential direction and may measure the angular velocity of the output shaft or measure both of the acceleration and the angular velocity in the circumferential direction of the output shaft 126.

(2) The controller of the impact rotation tool 101 (stop determination unit 166 and motor controller 151) may control the motor 110 using the tightening torque obtained by the torque computation unit 160.

(3) The torque calculation unit 165 obtains the inertial torque from the angular acceleration a1 of the output shaft 126 and the moment of inertia I1 of the distal portion of the output shaft 126 and the bit 100 attached to the distal end of the output shaft 126. The torque calculation unit 165 subtracts the inertial torque from the measured value T1 of the torque sensor 130 and obtains the tightening torque T2 (refer to equation 7). This allows the tightening torque tT2 to be obtained with further accuracy as compared to when setting the measured value T1 as the tightening torque T2 without taking the inertial torque into consideration.

(4) It is preferred that the torque computation unit 160 obtain average values of a constant time as the measured torque value of the torque sensor 130 and the angular acceleration of the output shaft 126 obtained from the measured value of the acceleration sensor 140. This reduces errors in the calculated value of the tightening torque caused by the influence of noise or the like.

The second embodiment may be modified as described below.

In the second embodiment, the torque calculation unit 165 calculates the measured value T1 of the torque as the average value of a fixed period (predetermined period), and the angular acceleration calculation unit 163 calculates the measured value a1 of the angular acceleration as the average value of a fixed period (predetermined period). Instead, an average value may be used for only one of the measured value T1 of the torque and the measured value a1 of the angular acceleration.

In the second embodiment, the acceleration sensor 140, which serves as the second measurement unit, is coupled to the peripheral portion of the output shaft 126, and the acceleration $\alpha 1$ in the circumferential direction and the acceleration $\alpha 2$ in the radial direction are measured. The angular acceleration calculation unit 163 of the torque computation unit 160 divides the acceleration $\alpha 1$ in the circumferential direction $\alpha 1$ measured by the acceleration sensor 140 by the distance (r) from the center position of the output shaft 126 to the coupling position of the acceleration sensor 140 to obtain the angular acceleration ($\alpha 1/r$). In this configuration, the angular acceleration calculation unit 163 may obtain, as the angular acceleration, the maximum value of the angular acceleration in the rotation stop direction or the average value of the angular acceleration during a predetermined period including when the angular acceleration becomes the maximum in the rotation stop direction. Further, the angular acceleration may be calculated using the single acceleration sensor 140 that measures the acceleration in the circumferential direction.

Figure 13A:
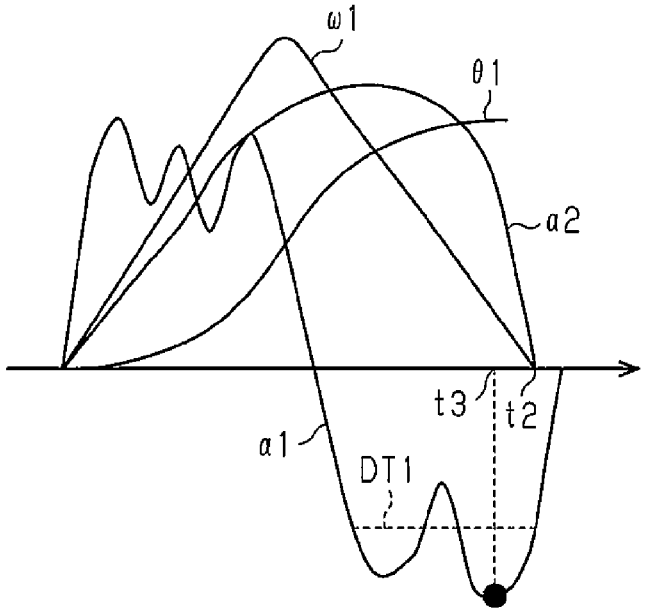
FIG. 13A is a waveform chart illustrating how the angular acceleration is calculated in the impact rotation tool of the second embodiment.

In this configuration, the torque computation unit 160 may use the angular acceleration at a predetermined time before a stop timing at which the acceleration $\alpha 2$ in the radial direction measured by the acceleration sensor 140 becomes zero. FIG. 13A shows, when an impact occurs, the angle $\alpha 1$ of the output shaft 126, the acceleration $\alpha 1$ in the circumferential direction, the acceleration $\alpha 2$ in the radial direction, and the time change of the angular velocity $\omega 1$. When the output shaft 126 stops rotating, the centrifugal force is zero. Thus, the acceleration $\alpha 2$ in the radial direction is zero (time t2 in FIG. 13A). This allows the torque computation unit 160 to accurately determine the stop timing (time t2) when the output shaft 126 stops rotating based on the time at which the acceleration $\alpha 2$ in the radial direction becomes zero. Further, the torque computation unit 160 may use the angular acceleration at a predetermined time before the stop timing (time t2) to compute the tightening torque. The predetermined time before the stop timing is the time of the detection of the angular acceleration optimal for the calculation of the tightening torque. The torque computation unit 160 may obtain the average value of the angular acceleration during a fixed period DT1 (predetermined period) before the stop timing (time t2) and use the average value of the acceleration to compute the tightening torque.

Figure 13B:
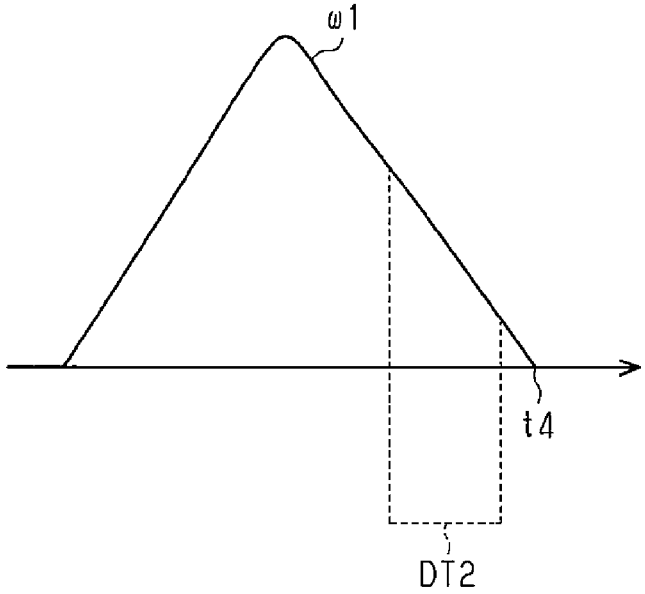
FIG. 13B is a waveform chart illustrating how the angular acceleration is calculated in the impact rotation tool of the second embodiment.

Further, in the impact rotation tool 101 of the second embodiment, in lieu of the acceleration sensor 140, the second measurement unit may be coupled to the peripheral portion of the central portion of the output shaft 126 to measure the angular velocity $\omega 1$ of the output shaft 126. FIG. 13B shows the measurement result of the angular velocity $\omega 1$ when an impact occurs. When the output shaft 126 stops rotating, the angular velocity $\omega 1$ becomes zero. The torque computation unit 160 may obtain the angular acceleration from the average change rate of the angular velocity $\omega 1$ during a fixed period DT2 until a predetermined time before a stop timing (time t4 in FIG. 13B) when the angular velocity $\omega 1$ measured by the second measurement unit becomes zero. Then, the torque computation unit 160 may use the angular acceleration to compute the tightening torque. This allows the stop timing of the output shaft 126 to be obtained from only the angular velocity measurement result of a single angular velocity sensor and also allows the angular acceleration used for computation of the tightening torque to be obtained. The torque computation unit 160 may obtain the angular acceleration from a differentiated value of the angular velocity $\omega 1$ during the fixed period DT2.

Figure 15A:
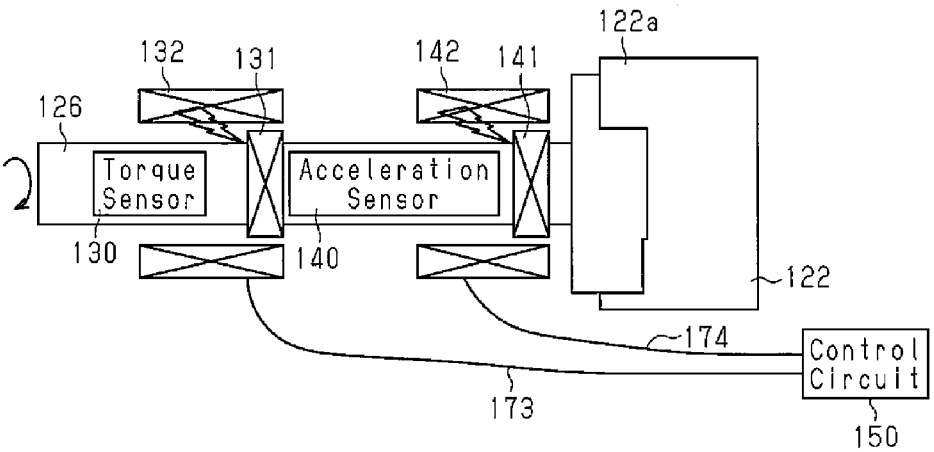
FIG. 15A is a schematic diagram illustrating a modified example of the impact rotation tool shown in FIG. 8.

In the impact rotation tool 101 of the second embodiment, the torque sensor 130 is coupled to the main body 102 to measure the torque applied to the output shaft 126 in a non-contact manner. However, a torque sensor 130 that directly detects the torque applied to the output shaft 126 may be coupled to the output shaft 126. In this case, as shown in FIG. 15A, communication coils 131 and 132 may be used to supply power to the torque sensor 130 that is coupled to the output shaft 126 and receive a signal from the torque sensor 130. The communication coil 131 is fixed to the circumferential surface of the output shaft 126. The communication coil 131 is formed by a tubular coil, and the output shaft 126 extends through the center of the communication coil 131. The communication coil 132 is arranged facing the communication coil 131. The wire 173 electrically connects the communication coil 132 to the control circuit 150. When the control circuit 150 supplies the communication coil 132 with alternating current, current flows to the communication coil 131 due to mutual induction. The current is rectified and smoothened, and the torque sensor 130 is supplied with operational power. Further, the torque sensor 130 provides the communication coil 131 with a pulse signal having a frequency that differs from that of the alternating current supplied from the control circuit 150 to transmit the measured value to the control circuit 150 through the communication coil 132. This allows the control circuit 150 to supply the torque sensor 130 with power in a non-contact manner and receive the measured value of the torque sensor 130 in a non-contact manner.

That is, in this modified example, the output shaft 126 includes a power receiving unit (communication coils 131 and 141) that receive operational power in a non-contact manner for the torque sensor 130 and the acceleration sensor 140 from the communication unit (communication coils 132 and 142) fixed to the main body 102. Further, the output shaft 126 includes the communication unit (communication coils 131 and 141) that outputs the measured values of the torque sensor 130 and the acceleration sensor 140 to the torque computation unit 160 stored in the main body 102. At least one of the power supplying unit and the communication unit operates when the impact mechanism 120 is not intermittently applying power to the output shaft 126. During the period in which the impact mechanism 120 is not applying an impact force to the output shaft 126, the electromagnetic noise generated from the motor 110 is relatively small. Thus, by operating the power supplying unit and the communication unit during this period, erroneous operations resulting from electromagnetic noise would be limited.

In lieu of the configuration shown in FIG. 15A, only one of the torque sensor 130 and the acceleration sensor 140 may be supplied with power in a non-contact manner, and a measurement signal of the torque sensor 130 may be received in a non-contact manner.

Figure 15B:
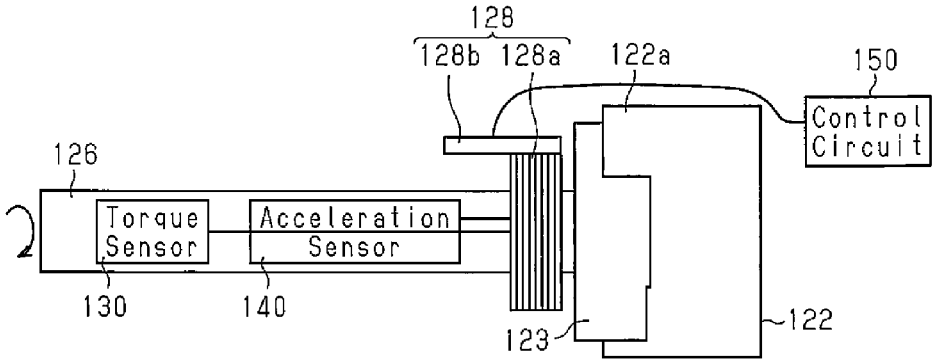
FIG. 15B is a schematic diagram illustrating a modified example of the impact rotation tool shown in FIG. 8.

Further, as shown in FIG. 15B, a slip ring 128 may be used to electrically connect the torque sensor 130 and the acceleration sensor 140, which are coupled to the output shaft 126, to the control circuit 150, which is accommodated in the main body 102. The slip ring 128 includes an annular power line 128*a*, which is formed throughout the circumferential surface that is coaxial with the output shaft 126, and a brush 128*b*, which is fixed to the main body 102 and which elastically contacts the power line 128*a*. A wire electrically connects the brush 128*b* to the control circuit 150. In this configuration, the slip ring 128 electrically connects the torque sensor 130 and the acceleration sensor 140 to the control circuit 150. That is, the torque sensor 130 and the acceleration sensor 140 are supplied with operational power via the slip ring 128 from the control circuit 150. The measurement signals of the torque sensor 130 and the acceleration sensor 140 are provided to the control circuit 150 and the torque computation unit 160 via the slip ring 128. In this configuration, even in an environment including a large amount of electromagnetic noise, the measurement signals of the torque sensor 130 and the acceleration sensor 140 may be transmitted to the control circuit 150. When power is supplied and measurement signals are transferred through the slip ring 128, it is preferred that power is supplied and measurement signals are transferred during a period when the impact mechanism 120 does not apply an impact force to the output shaft 126.

In the second embodiment, for example, Micro-Electro-Mechanical Systems (MEMS) technology may be used to arrange all or a portion of the torque computation unit 160 integrally with one or both of the first measurement unit (torque sensor 130) and the second measurement unit (acceleration sensor 140). In this case, the measurement unit (one or both of first and second measurement units) integrated with all or a portion of the torque computation unit 160 may be coupled to the output shaft 126 (e.g., vicinity of communication coil or slip ring in output shaft 126).

Alternatively, all or a portion of the torque computation unit 160 may be, for example, reduced in size using the MEMS technology and be coupled to the output shaft 126 (e.g., vicinity of the communication coil or the slip ring in the output shaft 126) together with the first measurement unit and the second measurement unit.

Figure 16A:
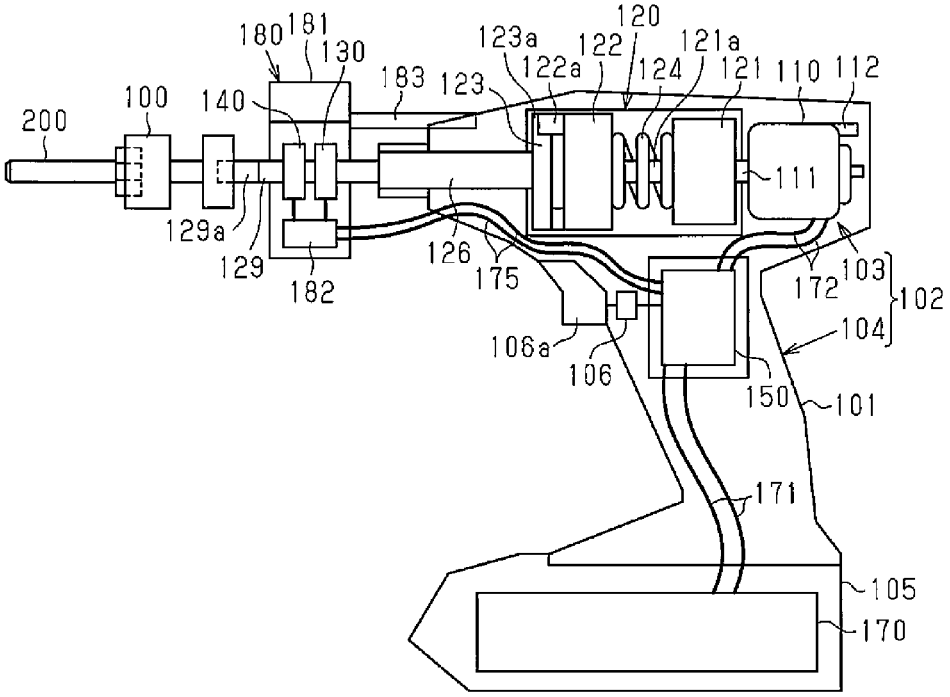
FIG. 16A is a schematic cross-sectional view showing an attachment that is attachable to the impact rotation tool of FIG. 8.

As shown in FIG. 16A, the attachment 180, which includes the torque sensor 130, the acceleration sensor 140, and a control circuit 182 may be attached in a removable manner to the impact rotation tool 101. The control circuit 182 of the attachment 180 measures the tightening torque and outputs a control signal, which is based on the measured value of the tightening torque or a measured value of the tightening torque, to the impact rotation tool 101.

Figure 17:
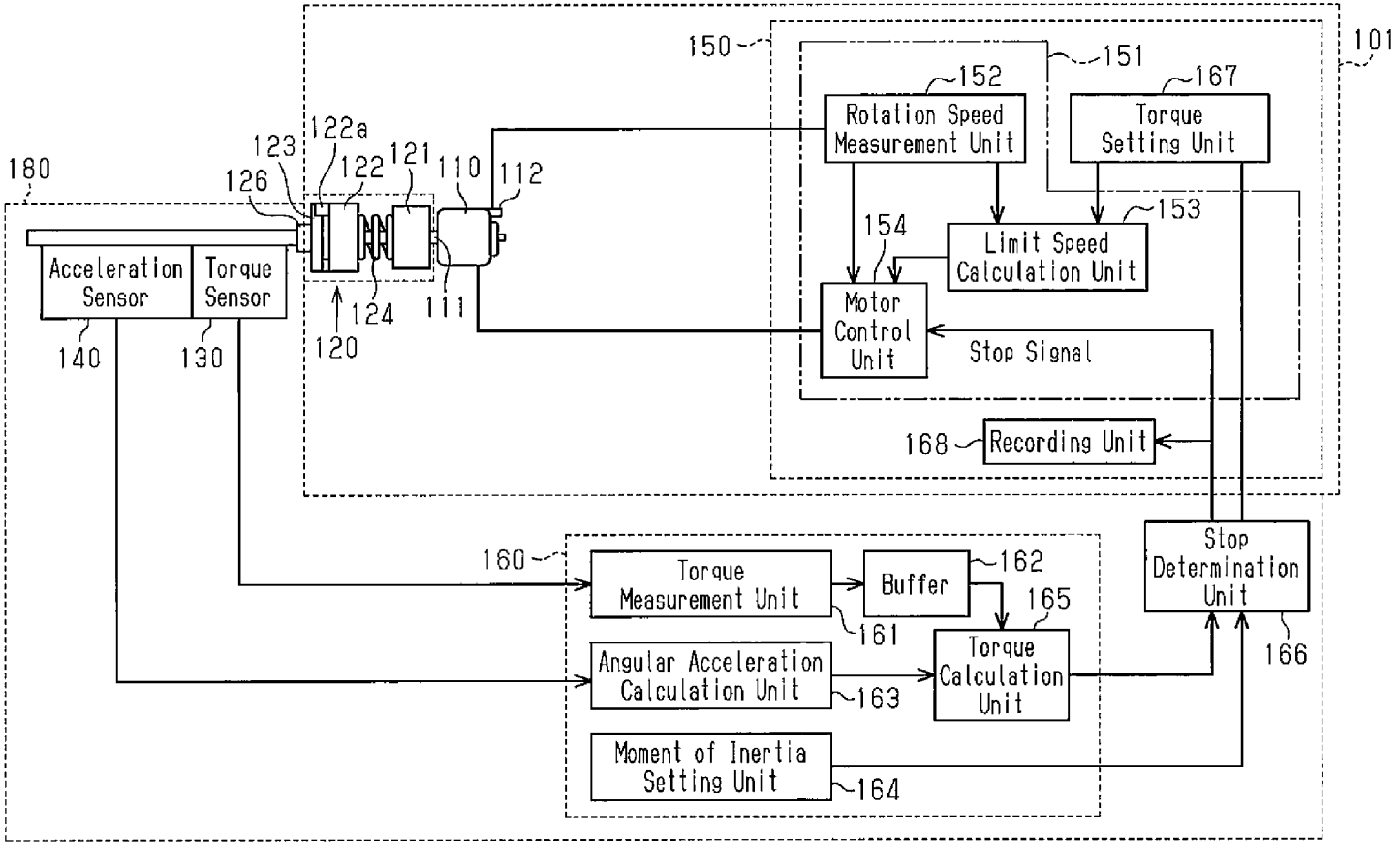
FIG. 17 is a block diagram showing the electric configuration of the impact rotation tool and the attachment shown in FIG. 16A.

As shown in FIG. 17, the control circuit 182 includes the torque computation unit 160 and the stop determination unit 166 of the second embodiment. In the configuration of FIG. 17, the control circuit 150 is similar to the control circuit 150 of the second embodiment except in that the torque computation unit 160 and the stop determination unit 166 are arranged in the control circuit 150. Hereafter, same reference numerals are given to those components that are the same as the corresponding components of the second embodiment. Such components will not be described in detail.

As shown in FIG. 16A, the attachment 180 includes a housing 181, which serves as a case attached in a removable manner to the main body of the impact rotation tool 101.

Figure 16B:
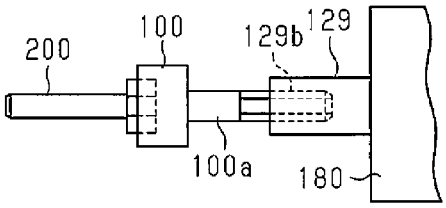
FIG. 16B is a side view showing a modified example of the impact rotation tool shown in FIG. 8.

The housing 181 rotatably supports an output shaft 129 to which the acceleration sensor 140 and the torque sensor 130 are coupled. The two ends of the output shaft 129 project out of the housing 181. The rear end of the output shaft 129 is coupled to the distal end of the output shaft 126 arranged integrally with the anvil 123. The distal end of the output shaft 129 includes a square rod 129*a*. The bit 100 is attached to the square rod 129*a* to tighten a fastener 200. As shown in FIG. 16B, the distal end of the output shaft 129 may include a hexagonal hole 129*b* in lieu of the square rod 129*a*. In this case, a hexagonal shank 100*a* of the bit 100 is inserted into the hexagonal hole 129*b* of the output shaft 129 to attach the bit 100 to the output shaft 129. In the same manner as the second embodiment, a communication coil (not shown) is used to supply power to and communicate with the acceleration sensor 140 and the torque sensor 130, which are coupled to the output shaft 129. However, a snap ring may be used to supply power and perform communication.

A fastener 183, such as a support pin or the like, fixes the housing 181 to the front side of the main body 102 and is coupled so that the housing 181 does not rotate relative to the main body 102.

When the tightening torque T2 reaches the target torque T0, the control circuit 182 outputs a stop signal. A wire 175 electrically connects the control circuit 182 to the control circuit 150, which is accommodated in the main body 102. This transfers signals between the control circuit 150 and the control circuit 182 through the wire 175. Further, the control circuit 182 is supplied with operational power through the wire 175 from the control circuit 150.

The attachment 180 of the impact rotation tool 101 is realized as a distal end attachment coupled in a removable manner to the main body 102 of the impact rotation tool 101. The operation of the impact rotation tool 101 that includes such an attachment 180 is similar to the second embodiment and will not be described in detail.

The use of the attachment 180 allows the torque measurement function to be added to an impact rotation tool that does not include a function for measuring the torque applied to the output shaft or a function for measuring the acceleration or angular velocity of the output shaft. Further, the torque sensor 130 and the acceleration sensor 140 are accommodated in the housing 181. This facilitates the task for replacing or adding the torque sensor 130 and the acceleration sensor 140.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

The invention claimed is:

1. An impact rotation tool comprising:

a drive source;

an impact force generation unit configured to generate an impact force for converting power from the drive source to pulsed torque;

a shaft arranged to transmit the pulsed torque to a bit used to perform a tightening task;

a torque measurement unit configured to measure torque applied to the shaft as measured torque;

a rotation angle measurement unit configured to measure a rotation angle of the shaft;

a tightening torque calculation unit configured to calculate an angular acceleration from the rotation angle and calculate a tightening torque based on the angular acceleration and the measured torque; and a controller configured to control the drive source based on the tightening torque, wherein when T represents the tightening torque, Ts represents the measured torque, I represents a moment of inertia of the shaft, and $\alpha$ represents the angular acceleration, the tightening torque calculation unit is configured to calculate the tightening torque from the equation of $T=Ts\times A-I\times\alpha\times B+C$, where A, B, and C are correction coefficients.

2. The impact rotation tool according to claim 1, wherein the tightening torque calculation unit is configured to calculate an approximation curve of the rotation angle measured by the rotation angle measurement unit and to calculate the angular acceleration by differentiating the approximation curve twice.

3. The impact rotation tool according to claim 2, wherein the tightening torque calculation unit is configured to calculate a quadratic approximation curve of the rotation angle measured by the rotation angle measurement unit and to calculate the angular acceleration by differentiating the quadratic approximation curve twice.

4. The impact rotation tool according to claim 1, wherein the tightening torque calculation unit is configured to calculate the average value of the measured torque during a predetermined period and to calculate the average value of the angular acceleration during the predetermined period.

5. The impact rotation tool according to claim 1, wherein the tightening torque calculation unit is configured to determine a tightening period from a first timing to a second timing whenever an impact force is generated, wherein the first timing is when the rotation angle increased by the present impact force becomes the same as a maximum rotation angle obtained during the generation of the preceding impact force, and the second timing is when the rotation angle increased by the present impact force becomes a maximum rotation angle obtained during the generation of the present impact force, and the tightening torque calculation unit is configured to calculate an approximation curve of the rotation angle based on a period including at least part of the tightening period.

6. The impact rotation tool according to claim 1, wherein the measured torque obtained by the torque measurement unit is a peak value of a predetermined period.

7. An impact rotation tool attachment that is attachable to an impact rotation tool, wherein the impact rotation tool includes an impact force generation unit configured to generate impact force for converting power from a drive source to pulsed torque, a shaft arranged to transmit the pulsed torque to a bit used to perform a tightening task, and a controller configured to control the drive source, the attachment comprising:

a torque measurement unit configured to measure torque applied to the shaft as a measured torque;

a rotation angle measurement unit configured to measure a rotation angle of the shaft; and a tightening torque calculation unit configured to calculate an angular acceleration from the rotation angle to calculate a tightening torque based on the angular acceleration and the measured torque, wherein when T represents the tightening torque, Ts represents the measured torque, I represents a moment of inertia of the shaft, and $\alpha$ represents the angular acceleration, the tightening torque calculation unit is configured to calculate the tightening torque from the equation of $T=Ts\times A-I\times\alpha\times B+C$, where A, B, and C are correction coefficients.

8. An impact rotation tool comprising:

a drive source;

an impact force generation unit configured to generate an impact force for converting power from the drive source to pulsed torque;

a shaft arranged to transmit the pulsed torque to a bit used to perform a tightening task;

a first measurement unit configured to measure torque applied to the shaft as a measured torque;

a second measurement unit configured to measure at least one of acceleration in a circumferential direction of the shaft and an angular velocity of the shaft;

a torque computation unit configured to calculate a tightening torque from the measured torque of the first measurement unit and an inertial torque of the shaft and the bit obtained with a measured value of the second measurement unit; and a controller configured to control the drive source based on the tightening torque, wherein when T2 represents the tightening torque, T1 represents the measured torque of the first measurement unit, a1 represents an angular acceleration of the shaft obtained from the measured value of the second measurement unit, and I1 represents a moment of inertia of the bit and a portion of the shaft located at a distal side of where the second measurement unit is coupled, the torque computation unit is configured to calculate the tightening torque from the equation of $T2=T1\times A-I1\times a1\times B+C$, where A, B, and C are correction coefficients.

9. The impact rotation tool according to claim 8, wherein the torque computation unit is configured to use an average value of a predetermined period for one or both of the measured torque of the first measurement unit and an angular acceleration of the shaft obtained from the measured value of the second measurement unit.

10. The impact rotation tool according to claim 8, wherein:

the second measurement unit is coupled to a peripheral portion of the shaft and configured to measure acceleration in the circumferential direction of the shaft;

the torque computation unit is configured to obtain the angular acceleration by dividing the acceleration in the circumferential direction of the shaft by the distance from a center position of the shaft to a coupling position of the second measurement unit; and the torque computation unit is configured to calculate the tightening torque using (i) the maximum value of the angular acceleration in a rotation stop direction of the drive source, (ii) the angular acceleration at a predetermined time before or after when the angular acceleration is the maximum in the rotation stop direction, or (iii) an average value of the angular acceleration in a predetermined period including when the angular acceleration is the maximum in the rotation stop direction.

11. The impact rotation tool according to claim 8, wherein:

the second measurement unit is coupled to a peripheral portion of the shaft and configured to measure acceleration in a circumferential direction of the shaft and acceleration in a radial direction of the shaft;

the torque computation unit is configured to obtain the angular acceleration by dividing the acceleration in the circumferential direction of the shaft by the distance from a center position of the shaft to a coupling position of the second measurement unit; and the torque computation unit is configured to calculate the tightening torque using (i) the angular acceleration at a predetermined time before a stop timing at which the acceleration in the radial direction of the shaft becomes zero or (ii) an average value of the angular acceleration in a predetermined period before the stop timing.

12. The impact rotation tool according to claim 8, wherein the second measurement unit is coupled to a peripheral portion of the shaft and configured to measure an angular velocity of the shaft, and the torque computation unit is configured to calculate the angular acceleration from a differentiated value or an average change rate of the angular velocity during a fixed period until a predetermined time before a stop timing at which the angular velocity becomes zero.

13. The impact rotation tool according to claim 8, further comprising:

a main body configured to accommodate the impact force generation unit and the torque computation unit;

a power supplying unit fixed to the main body; and a power receiving unit located on the shaft to receive operational power for the first and second measurement units in a non-contact manner from the power supplying unit, wherein the power receiving unit further functions as a communication unit that transmits the measured value of the first measurement unit and the measured value of the second measurement unit to the torque computation unit in a non-contact manner, the impact force generation unit is configured to intermittently apply the pulsed torque to the shaft, and at least one of the power supplying unit and the communication unit is configured to operate during a period in which the impact force generation unit is not applying impact force to the shaft.

14. The impact rotation tool according to claim 8, further comprising:

a main body configured to accommodate the impact force generation unit and the torque computation unit; and a case coupled in a removable manner to the main body and configured to accommodate the first measurement unit and the second measurement unit, wherein the measured value of the first measurement unit and the measured value of the second measurement unit are output to the torque computation unit accommodated in the main body.

15. An impact rotation tool attachment that is attachable to an impact rotation tool, wherein the impact rotation tool includes an impact force generation unit configured to generate impact force for converting power from a drive source to pulsed torque, a shaft arranged to transmit the pulsed torque to a bit used to perform a tightening task, and a controller configured to control the drive source, the attachment comprising:

a first measurement unit configured to measure torque applied to the shaft as a measured torque;

a second measurement unit configured to measure at least one of an acceleration in a circumferential direction of the shaft and an angular velocity of the shaft; and a torque computation unit configured to calculate a tightening torque from the measured torque of the first measurement unit and an inertial torque of the shaft and the bit obtained with a measured value of the second measurement unit, wherein the torque computation unit is configured to output to the controller at least one of the calculated value of the tightening torque and a control signal of the drive source generated based on the calculated value of the tightening torque, and wherein when T2 represents the tightening torque, T1 represents the measured torque of the first measurement unit, a1 represents an angular acceleration of the shaft obtained from the measured value of the second measurement unit, and I1 represents a moment of inertia of the bit and a portion of the shaft located at a distal side of where the second measurement unit is coupled, the torque computation unit is configured to calculate the tightening torque from the equation of $T2=T1\times A-I1\times a1\times B+C$, where A, B, and C are correction coefficients.

* * * * *